US006701096B2

(12) United States Patent
Arai et al.

(10) Patent No.: US 6,701,096 B2
(45) Date of Patent: Mar. 2, 2004

(54) IMAGE-FORMING DEVICE HAVING CONSUMABLE COMPONENT WITH INTERNAL FUSE

(75) Inventors: Kazuaki Arai, Tokyo (JP); Koichi Negishi, Tokyo (JP); Takao Uchida, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/136,815

(22) Filed: May 1, 2002

(65) Prior Publication Data

US 2002/0164169 A1 Nov. 7, 2002

(30) Foreign Application Priority Data

May 2, 2001 (JP) ..... 2001-134966
Apr. 19, 2002 (JP) ..... 2002-117092

(51) Int. Cl.[7] ..... G03G 15/00
(52) U.S. Cl. ..... 399/12
(58) Field of Search ..... 399/12, 13, 25, 399/31, 111

(56) References Cited

U.S. PATENT DOCUMENTS 5,021,828 A 6/1991 Yamaguchi et al.
5,303,005 A 4/1994 Takano et al.
6,104,888 A 8/2000 Kobayashi

*Primary Examiner*—Hoang Ngo
(74) *Attorney, Agent, or Firm*—Akin Gump Strauss Hauer & Feld LLP

(57) ABSTRACT

A printer uses a consumable component having an internal fuse that is blown when the consumable component is installed. In one aspect of the invention, the consumable component includes a resistor connected in series with the fuse. Before the fuse is blown, the resistance value of the resistor is checked to make sure that the correct type of consumable component has been installed. In another aspect of the invention, if the fuse fails to blow on the first attempt, this is recorded in a memory and a second attempt is made later, the consumable component being used in the meantime. In still another aspect of the invention, the consumable component includes a resistor or thermistor connected in parallel with the fuse, enabling a consumable component with a blown fuse to be distinguished from a consumable component that is not installed.

17 Claims, 22 Drawing Sheets

IMAGE-FORMING DEVICE HAVING CONSUMABLE COMPONENT WITH INTERNAL FUSE

BACKGROUND OF THE INVENTION

1. Field of the Invention

The present invention relates to an image-forming device such as a printer, more specifically to the management of a consumable component in such a device.

2. Description of the Related Art

One example of an image-forming device in which the present invention can be practiced is the tandem color electrophotographic printer 1 shown in FIGS. 17 and 18: FIG. 17 is a side sectional view; FIG. 18 is a schematic block diagram of the printing engine.

The printer in these drawings has a low-voltage power source 2, a high-voltage power source 3, and four printing mechanisms: a yellow (Y) printing mechanism 4, a magenta (M) printing mechanism 5, a cyan (C) printing mechanism 6, and a black (K) printing mechanism 7. The printing mechanisms include respective photosensitive drum units (ID units) 4*a*–7*a*, light-emitting diode (LED) heads 4*b*–7*b*, discharge lamps 4*c*–7*c*, and transfer rollers 4*e*–7*e*, and are driven by respective motors 4*d*–7*d*.

Printing media such as sheets of paper, not shown, are placed in a cassette tray 8, and fed into the printer 1 by the rotation of a hopping roller 9. An attraction roller 10 generates a static electric charge that holds the printing media to a transfer belt in a transfer belt unit 11. Driven by the rotation of a transfer-belt driving roller 11*a*, the transfer belt carries the printing media past the printing mechanisms 4–7, which perform printing processes that transfer yellow, magenta, cyan, and black toner images onto the printing media. The media next pass through a fuser 12, which fuses the toner images onto them, and are finally delivered into a stacker 13. The printing media may also be supplied manually, in which case they are fed into the printer 1 by a front roller 14, but the subsequent printing operations are the same.

These printing operations are controlled by the engine controller 15 in FIG. 18. The engine controller 15 controls the LED heads 4*b*–7*b* through a relay board 16, and directly controls the discharge lamps 4*c*–7*c*, the above-mentioned motors (M) 4*d*–7*d*, a hopping motor 9*d* that drives the hopping roller 9, a belt motor 11*d* that drives the transfer-belt driving roller 11*a*, a heater motor 12*d* that drives a heating roller in the fuser 12, a front motor 14*d* that drives the front roller 14, and the power sources 2, 3. The low-voltage power source 2 supplies power to a heat source such as a halogen lamp (not shown) in the fuser 12. The high-voltage power source 3 supplies power to the ID units 4*a*–7*a* and the transfer belt unit 11. The engine controller 15 is also connected to various sensors 17, such as a sensor that senses the presence of printing media and a sensor that senses whether the printer's cover is open or closed.

In this printer 1, the ID units 4*a*–7*a*, the transfer belt 11, and the fuser 12 are consumable components that must be replaced at the end of their service lives. To tell the user when to replace the consumable components, the printer has counters that count the cumulative number of rotations made by rotating parts such as the photosensitive drums. When a counter reaches a predetermined value, the printer displays a service-life alarm indicating that the corresponding consumable component needs replacement. Notified by this alarm, the user can replace the consumable component at the appropriate time.

When the consumable component is replaced, it is also necessary to reset the counter. It is known art to reset the counter automatically by means of the structure shown in FIG. 19. The consumable component 20, which may be any one of the ID units 4*a*–7*a*, or the transfer belt 11 or fuser 12, includes an internal fuse F1. The printer has a consumable-component sensing section 18 that senses whether the fuse F1 is blown. If the fuse F1 is not blown, the consumable-component sensing section 18 blows it and resets the counter.

The consumable-component sensing section 18 includes a transistor TR1, a resistor R1, and a central processing unit (CPU) 19, the functions of which will be described below with reference to the flowchart in FIG. 20.

When the printer's power is switched on or its cover is opened and then closed, to determine whether the consumable component 20 has been replaced, the CPU 19 reads (step S201) and tests (step S202) the input value at a one-bit digital input port IN, which is connected through fuse F1 to ground and through resistor R1 to a power supply (Vcc). If the input value is at the high logic level, indicating that fuse F1 is already blown and the consumable component 20 is not new, the CPU 19 terminates the process in FIG. 20. If the input value is at the low logic level, indicating that fuse F1 is not blown and the consumable component 20 is new, the CPU 19 resets the counter that keeps track of the service life of the consumable component 20 (step S203), and outputs a '0' pulse from an output port OUT (step S204), sending a current pulse through transistor TR1 to blow fuse F1. To confirm that fuse F1 has blown, the CPU 19 reads (step S205) and tests (step S206) the input value at the input port IN again. If the input value is at the high logic level, the process ends; if the input value is at the low logic level, steps S204, S205, and S206 are repeated until the input value becomes high, or until a limit number of repetitions is reached.

Consumable components such as the ID units, transfer belt, and fuser have different specifications for different printers, and when they are replaced, the user may mistakenly install a consumable component of the wrong type. Since there are four ID units with different toner colors, the user may also install an ID unit of the wrong color.

When this happens, a conventional printer cannot recognize that the consumable component has been incorrectly replaced, and operates as if the replacement had been made correctly, creating various problems. One problem is that the user does not realize that the wrong consumable component has been installed until a defective printing result is obtained, at which point the user must replace the consumable component again, repeat the printing job, and either dispose of the consumable component that was mistakenly installed, or store it for later use. Another problem is that the mistakenly installed consumable component now has a blown fuse, so if it is later reinstalled and used, its counter will not be reset, and its service life will not be indicated correctly.

If consumable components with different specifications or colors have different external shapes, these problems can be avoided by a mechanical interlocking mechanism that prevents the installation of the wrong type of consumable component, but such mechanisms increase the manufacturing cost of the printer and the consumable component.

Instead of a fuse, the consumable component may have an internal memory circuit storing, for example, identification information and either a count value or a flag indicating whether the consumable component is new or not, but this memory circuit also increases the cost of the consumable component.

Another problem is that when a new consumable component is installed, its fuse may fail to blow. In this case, a conventional printer displays an alarm indicating that the consumable component is defective, and disables printing. The user must then replace the consumable component again, even though its functioning is not normally impaired by the fuse failure, and the failure may be due to a temporary condition that will disappear later.

A further problem is that the printer cannot distinguish between the state in which the consumable component is not installed, and the state in which the consumable component is installed but has a blown fuse. One conventional solution to this problem is shown in FIG. 21. The consumable component 20 and sensing section 18 make electrical contact at three points 21, 22, 23. In the consumable component 20, contact point 22 is coupled directly to contact point 21, and is coupled to contact point 23 through the fuse F1. The consumable-component sensing section 18 now includes a transistor TR1, resistors R11–R16, a CPU 19 with input ports IN1 and IN2, and switching means (not shown) for making and breaking electrical contact at points 21 and 23. In the consumable-component sensing section 18, contact point 22 is coupled to the power supply (Vcc) through resistor R11, and contact point 23 is grounded. The functions of these elements will be explained with reference to the flowchart in FIG. 22.

When the printer's power is switched on or its cover is opened, then closed, the CPU 19 commands the switching means to make electrical contact at point 21 (step S211), then reads and tests the input value at input port IN1, which is connected through resistor R15 to contact point 21 and through resistor R16 to ground (step S212). If the IN1 input value is at the low logic level, indicating that the consumable component 20 is not installed, the CPU 19 displays an alarm indication on, for example, a display panel (step S213), then terminates the procedure.

If the IN1 input value is at the high logic level, indicating that the consumable component 20 is installed, the CPU 19 commands the switching means to break the electrical contact at point 21 and make electrical contact at point 23 (step S214), then reads and tests the input value at input port IN2, which is connected through resistor R13 to contact point 22 and through resistor R14 to ground (step S215). If the IN2 input is at the high logic level, indicating that fuse F1 is already blown, the CPU 19 terminates the procedure. If the IN2 input value is at the low logic level, indicating that fuse F1 is not blown, the CPU 19 resets the counter that keeps track of the service life of the consumable component 20 (step S216), and outputs a '0' pulse from output port OUT (step S217), sending current through transistor TR1 and resistor R12 to blow fuse F1, then reads and tests the IN2 input value again (step S218). Steps S217 and S218 are repeated until the IN2 input goes high, or until a limit number of repetitions is reached.

The conventional art shown in FIGS. 21 and 22, like that in FIGS. 19 and 20, has the drawback of being unable to distinguish between different types of consumable components. A further disadvantage is the need for a third electrical contact point 21, and the need for switching means for making and breaking the electrical contacts at points 21 and 23. The third contact point and switching means both take up extra space. The switching means also adds to the complexity of the printer and increases its cost.

The problems described above are not limited to electrophotographic printers, but can occur in other types of image-forming devices as well.

SUMMARY OF THE INVENTION

One object of the present invention is to provide an image-forming device with low-cost means for preventing the mistaken installation of an incorrect type of consumable component.

Another object of the invention is to enable a consumable component in an image-forming device to be used despite the temporary failure of a fuse to blow.

A further object is to enable a consumable component with a blown fuse to be distinguished from a consumable component that is not installed without the need for an extra electrical contact point.

A still further object of the invention is to provide a convenient means of monitoring the temperature inside the image-forming device.

The invented image-forming device has a replaceable consumable component with an internal fuse. When the consumable component is installed, the fuse is blown to indicate that the consumable component is no longer new. In addition, a counter in the image-forming device may be reset; thereafter, the counter measures the remaining service life of the consumable component by counting a predetermined repetitive operation that is executed when the consumable component is used.

According to a first aspect of the invention, the consumable component includes a resistor connected to, e.g., connected in series with the internal fuse. The resistance value of the resistor indicates the type of consumable component. Before blowing the fuse, the image-forming device determines the type of the consumable component. For instance, it determines whether the consumable component is of the correct type by measuring the resistance value of the resistor, and warns the user if the consumable component is of an incorrect type.

The image-forming device may also have means for short-circuiting the two ends of the fuse, so that the resistance value of the resistor can be measured even after the fuse has been blown. This feature is useful when the consumable component is temporarily removed, then reinstalled.

In an electrophotographic printer with replaceable photosensitive drum units having different toner colors, the resistance value may indicate the toner color.

The image-forming device may also have means for enabling the user to decide whether or not to reset the counter and blow the fuse when a consumable component of the correct type is installed. This enables the consumable component to be tested without blowing its fuse.

According to a second aspect of the invention, the image-forming device has a memory that stores fuse defect information. While attempting to blow the fuse in the consumable component, the image-forming device measures its resistance, first to decide whether the resistance is normal, then to determine whether the fuse has blown. If the fuse has normal resistance but fails to below within a predetermined time, the fuse defect information is checked. If this information does not indicate that the fuse had failed to blow in a previous attempt, then the counter is cleared and the consumable component is used for the time being, but its failure to blow is recorded in the memory, so that if the fuse again fails to blow on the next attempt, an alarm warning can be given. If the fuse is blown successfully on the next attempt, the indication of its failure to blow is cleared in the memory.

Before attempting to blow the fuse, the image-forming device may use a resistance measurement to determine whether the fuse is already blown, and if it is, clear the indication in the memory without resetting the counter.

If the replaceable consumable component is a photosensitive drum unit having a photosensitive drum making contact with a transfer roller through which current is supplied to charge the surface of the photosensitive drum, before measuring the resistance of the fuse, the image-forming device may measure the output voltage of the power source that supplies the current, to confirm that the photosensitive drum unit is properly installed, so that an uninstalled photosensitive drum unit will not be misinterpreted as an installed photosensitive drum unit with a blown fuse. If the photosensitive drum unit is not installed, the indication in the memory is not cleared and the counter is not reset.

According to a third aspect of the invention, the consumable component includes a resistor connected in parallel with the internal fuse between two points at which the consumable component makes electrical contact with the image-forming device. The electrical resistance between these two points then indicates whether or not the consumable component is installed, and if it is installed, whether or not its internal fuse is blown. The resistance value may also indicate whether the consumable component is of the correct type. The resistor may be a thermistor with a positive temperature coefficient, in which case the resistance value can be monitored to monitor the temperature inside the image-forming device.

The invention also provides a consumable component such as a photosensitive drum unit or a toner cartridge having a resistor coupled in parallel with an internal fuse.

DETAILED DESCRIPTION OF THE INVENTION

Embodiments of the invention will now be described with reference to the attached drawings. All of the embodiments are electrophotographic printers with consumable components having internal fuses, and with consumable-component sensing sections that blow these internal fuses and reset counters to measure the service lives of the consumable components.

Figure 1:
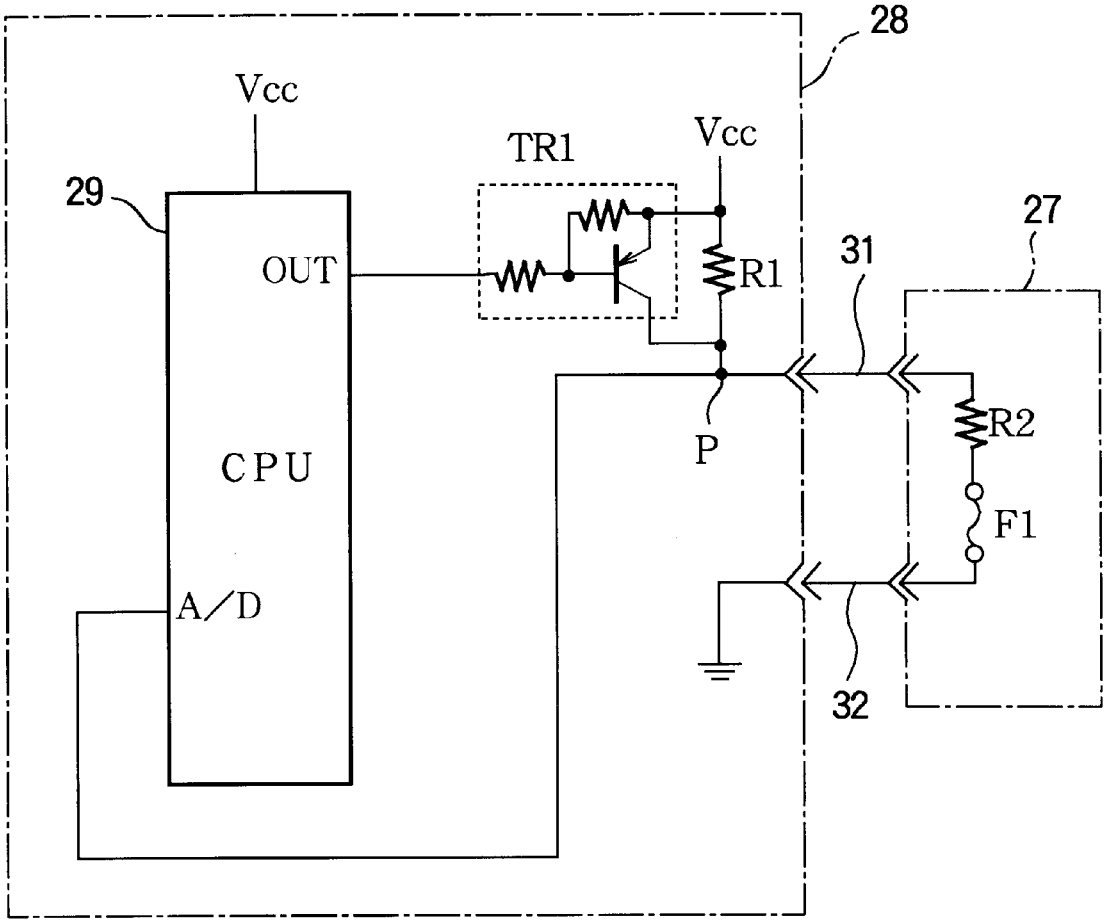
FIG. 1 is a circuit diagram showing relevant parts of a consumable component and its sensing section in a first embodiment of the invented image-forming device.

FIG. 1 schematically illustrates a consumable component 27 and its consumable-component sensing section 28 in a printer according to a first embodiment of the invention. The consumable-component sensing section 28 has a pnp bipolar transistor TR1 and a resistor R1 connected in parallel between a point P and, for example, a five-volt (5-V) power supply Vcc. The consumable component 27 has a resistor R2 and fuse F1, which are connected in series between point P and ground through a pair of points 31, 32 (shown as lines in the drawing) at which the consumable component 27 makes electrical contact with the consumable-component sensing section 28. Resistor R2 has a prescribed resistance value that differs depending on the type and specifications of the consumable component 27, but is low enough to permit fuse F1 to blow. The combined series resistance of resistors R2 and R1 is high enough to prevent fuse F1 from blowing.

The consumable-component sensing section 28 includes a CPU 29 such as a microcontroller that receives the voltage level of point P at an analog input port having an analog-to-digital (A/D) conversion function. By means of this function, the CPU 29 internally converts the voltage level at point P to, for example, an eight-bit digital value. The CPU 28 also has a one-bit digital output port (OUT) that controls transistor TR1, '0' output switching transistor TR1 on and '1' output switching it off.

Transistor TR1 includes internal resistors through which its base electrode is coupled to the output port OUT, and to its emitter electrode. The emitter electrode is connected to the power supply Vcc, and the collector electrode is connected to point P. Transistor TR1 is normally kept in the off state (OUT='1').

The operation of the first embodiment will be described below with reference to the flowchart in FIG. 2.

When the printer's power is switched on or its cover (not visible) is opened, then closed, the CPU 29 reads the A/D input value, representing the voltage level at point P, (step S1). If the fuse F1 is blown, this voltage level is substantially Vcc, the A/D input value is correspondingly high, and the subsequent steps in FIG. 2 are skipped.

If the A/D input value is not high enough to indicate a blown fuse, the CPU 29 next decides whether the A/D input value is equal to a prescribed value (step S2). The prescribed value is equivalent to the power-supply voltage Vcc divided by the resistances of resistors R1 and R2, provided resistor R2 has the prescribed resistance value. If the value read from the A/D input port differs from the prescribed value, indicating that a consumable component 27 of an incorrect type is installed, the user is informed that the consumable component 27 is out of specification by a display on a control panel (not shown), or by an audible alarm or the like (step S3).

If the A/D input value is substantially equal to the prescribed-value, indicating that the consumable component 27 is of the correct type and its fuse F1 is not yet blown, a counter that measures the service life of the consumable component 27 is reset (step S4). If, for example, the consumable component 27 is a photosensitive drum unit, its service life can be measured by counting rotations of the photosensitive drum. The counter, also referred to as a consumable component counter, may be a hardware counter, or a software counter that maintains a count value in, for example, an internal non-volatile memory in the CPU 29.

After resetting the consumable component counter, to blow the fuse F1, the CPU 29 sends a '0' pulse out from the output port OUT (step S5), switching on transistor TR1 for a certain interval. After this interval, to confirm that the fuse F1 has blown, the CPU 29 reads the voltage of point P from the A/D input port (step S6), and compares the A/D-converted value of the voltage with a predetermined value such as, for example, 'F0' (step S7). 'F0' is a hexadecimal value near the top of the eight-bit A/D conversion scale.

Figure 2:
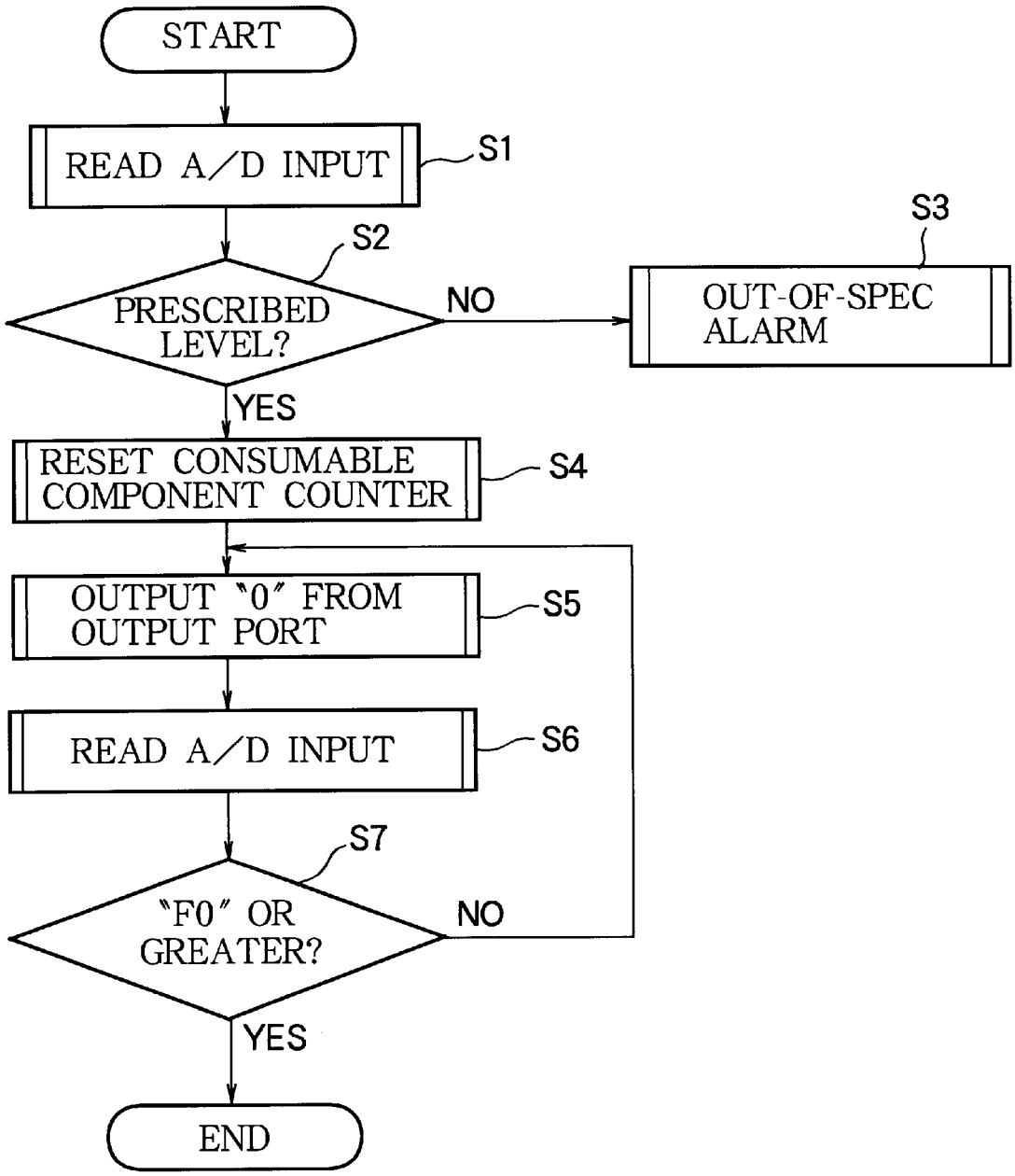
FIG. 2 is a flowchart describing the operation of the first embodiment.

If the A/D-converted value is equal to or greater than 'F0', indicating that the fuse F1 has blown, the process in FIG. 2 is terminated; if the value is less than 'F0', indicating that the fuse F1 has not yet blown, steps S5, S6, and S7 are repeated until the fuse F1 blows, or until a limit number of repetitions is reached. If fuse F1 does not blow within the limit number of repetitions, a fuse alarm is indicated, although this is not indicated in the drawing.

Sensing the voltage at point P before blowing the fuse F1 is equivalent to measuring the resistance value of resistor R2. Since this resistance value differs according to the type and specifications of the consumable component 27, before blowing the fuse F1, the printer can determine whether the consumable component 27 is of the correct type. Problems caused by the installation of an incorrect type of consumable component 27, such as defective printing results and the blowing of the fuse in the incorrectly installed consumable component, can therefore be avoided.

The consumable component 27 need not be a photosensitive drum unit, but may be, for example, a fuser, a belt unit, or a toner cartridge.

Figure 3:
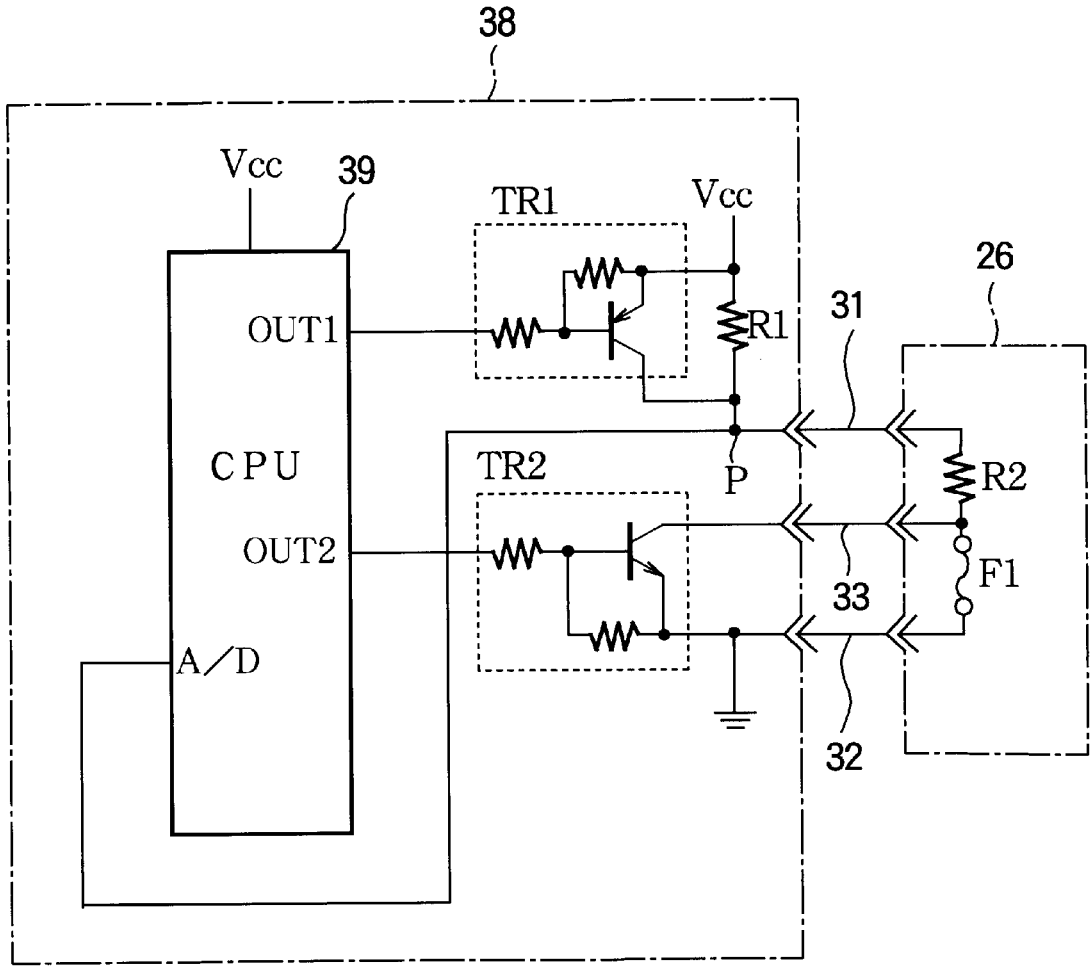
FIG. 3 is a circuit diagram showing relevant parts of a consumable component and its sensing section in a second embodiment of the invented image-forming device.

FIG. 3 schematically illustrates a consumable component 26 and its consumable-component sensing section 38 in a printer according to a second embodiment of the invention. The second embodiment differs from the first embodiment in that the consumable-component sensing section 38 has an npn bipolar transistor TR2, controlled through an output port OUT2 of the CPU 39, that can short-circuit the two ends of the fuse F1 in the consumable component 26. The emitter of transistor TR2 is connected through contact point 32 to one end of fuse F1; its collector is coupled through a third contact point 33 to the other end of fuse F1. The output port that controls transistor TR1 is now denoted OUT1.

Figure 4:
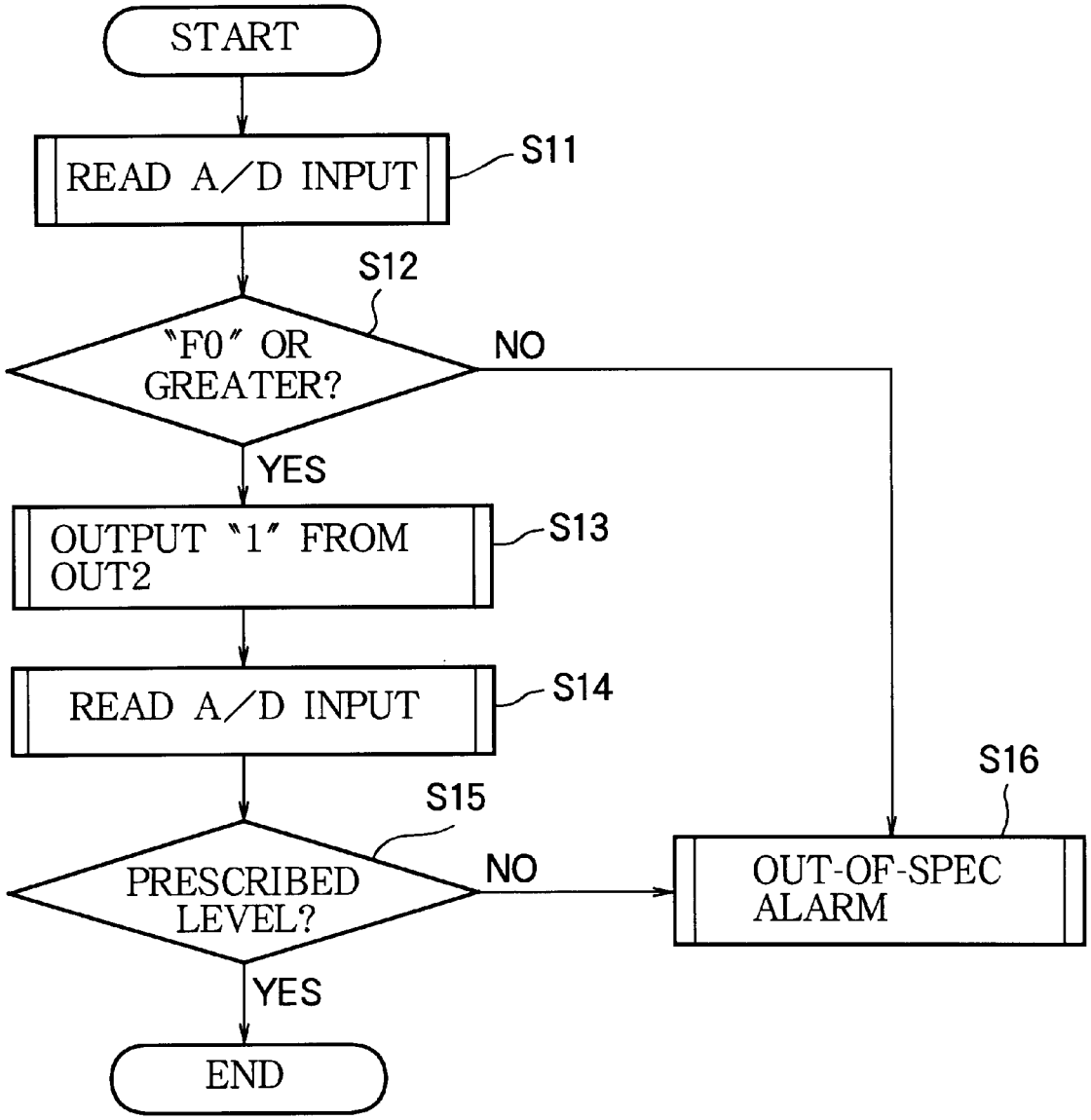
FIG. 4 is a flowchart describing the operation of the second embodiment.

The operation of the second embodiment when the user removes the consumable component 26 to correct a paper jam, for example, then reinstalls the same consumable component 26 will be described below with reference to the flowchart in FIG. 4.

The CPU 39 reads the voltage at point P from the A/D input port (step S11). To decide whether the fuse F1 has blown or not, the CPU 39 compares the read value with 'F0' (step S12). If the value is equal to or greater than 'F0', indicating that the fuse F1 is blown, the process proceeds to step S13 to determine whether the consumable component 26 is of the correct type or not.

In step S13, output port OUT2 is set for '1' output, turning on transistor TR2 and thereby short-circuiting the two ends of the fuse F1. Then the voltage at point P is read from the A/D input port again (step S14) and compared with the prescribed value, that is, with Vcc divided by R1 and R2 (step S15). If the voltage at point P has the prescribed value, the correct consumable component 26 is assumed to have been reinstalled, and the process ends.

If the value read from the A/D input port is lower than 'F0' in step S12, or if the value read from the A/D input port differs from the prescribed value in step S15, the wrong consumable component 26 is assumed to have been reinstalled, and the user is informed that the reinstalled consumable component is out of specification by an alarm display, an audible alarm, or the like (step S16).

In the second embodiment, the fuse F1 can be bypassed to measure the resistance of resistor R2, so even when a consumable component is temporarily removed and then reinstalled, the printer can check whether the reinstalled consumable component 26 is of the correct type.

In a variation of the second embodiment, if the A/D input value is less than 'F0' in step S12, indicating that the fuse F1 is not blown yet, the CPU 39 proceeds with steps S2 to S7 in FIG. 2.

In another variation of the second embodiment, transistor TR2 is first switched on to measure the resistance of resistor R2, then switched off to determine whether the fuse F1 is blown or not.

Figure 17:
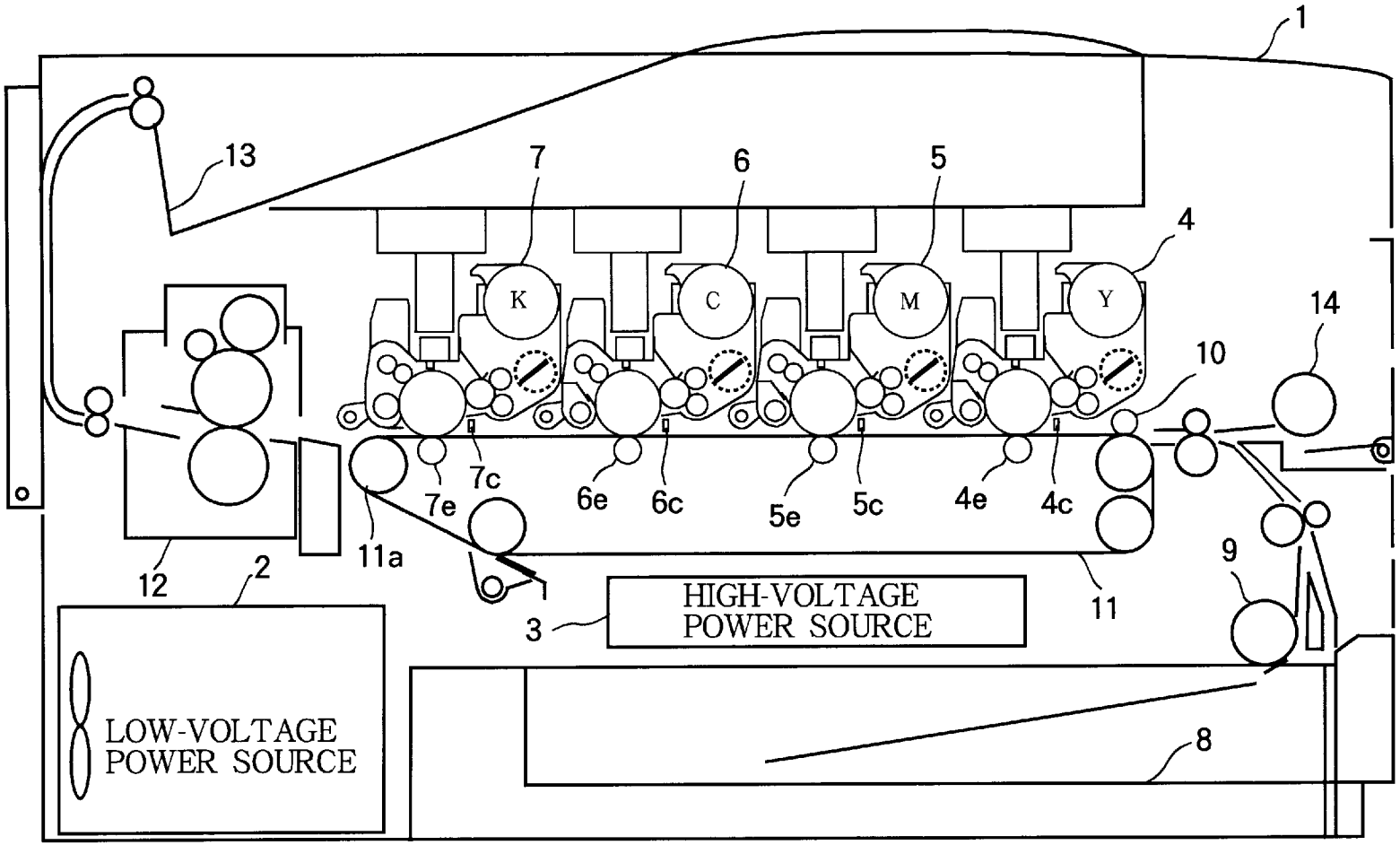
FIG.17 PRIOR ART
FIG. 17 is a sectional view showing the structure of a color electrophotographic printer.
Figure 18:
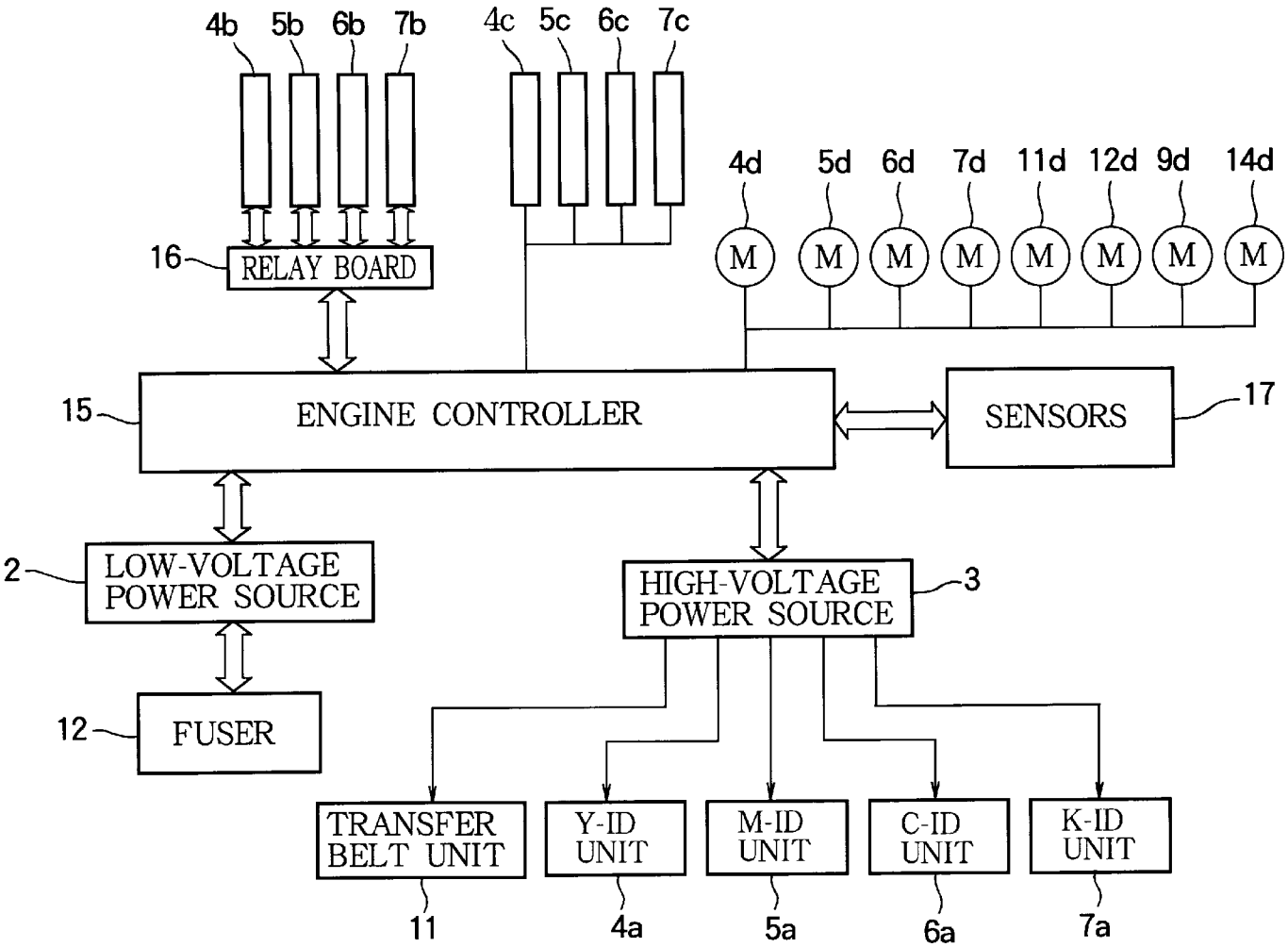
FIG.18 PRIOR ART
FIG. 18 is a block diagram of the printing engine of the printer in FIG. 17.
Figure 19:
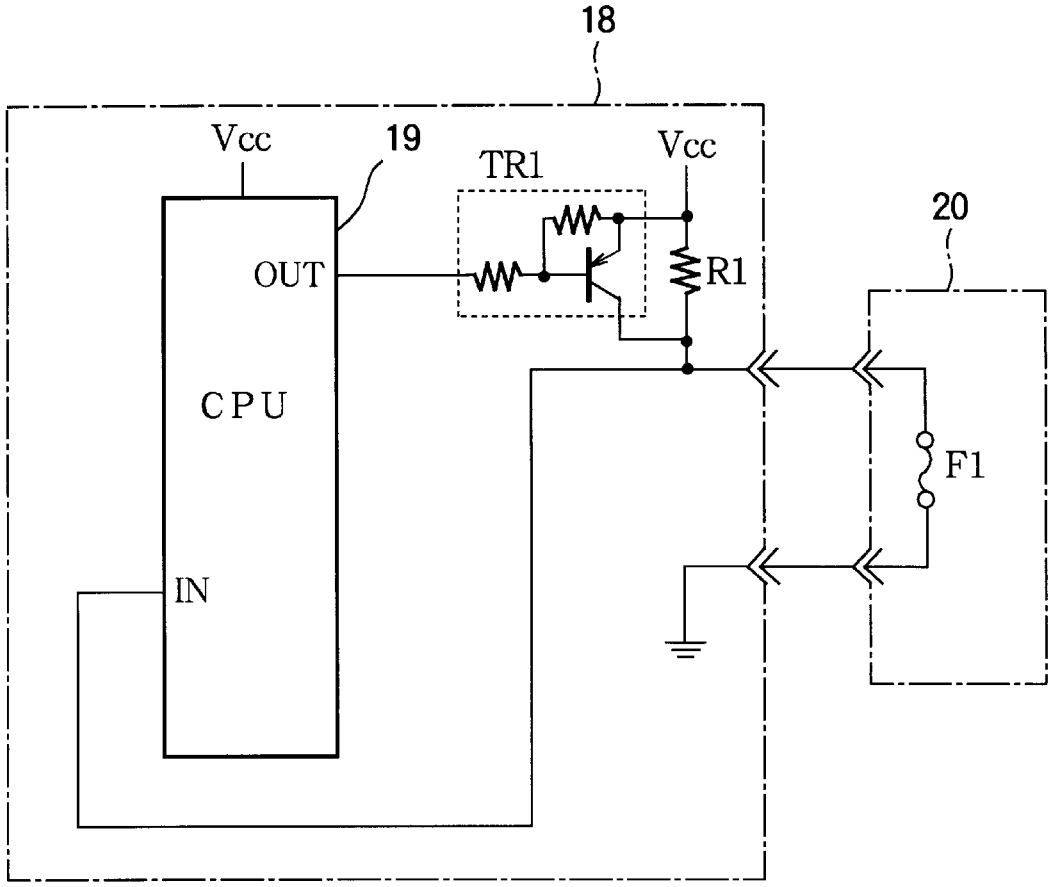
FIG.19 PRIOR ART
FIG. 19 is a circuit diagram showing the structure of a conventional consumable-component sensing section in a printer.
Figure 20:
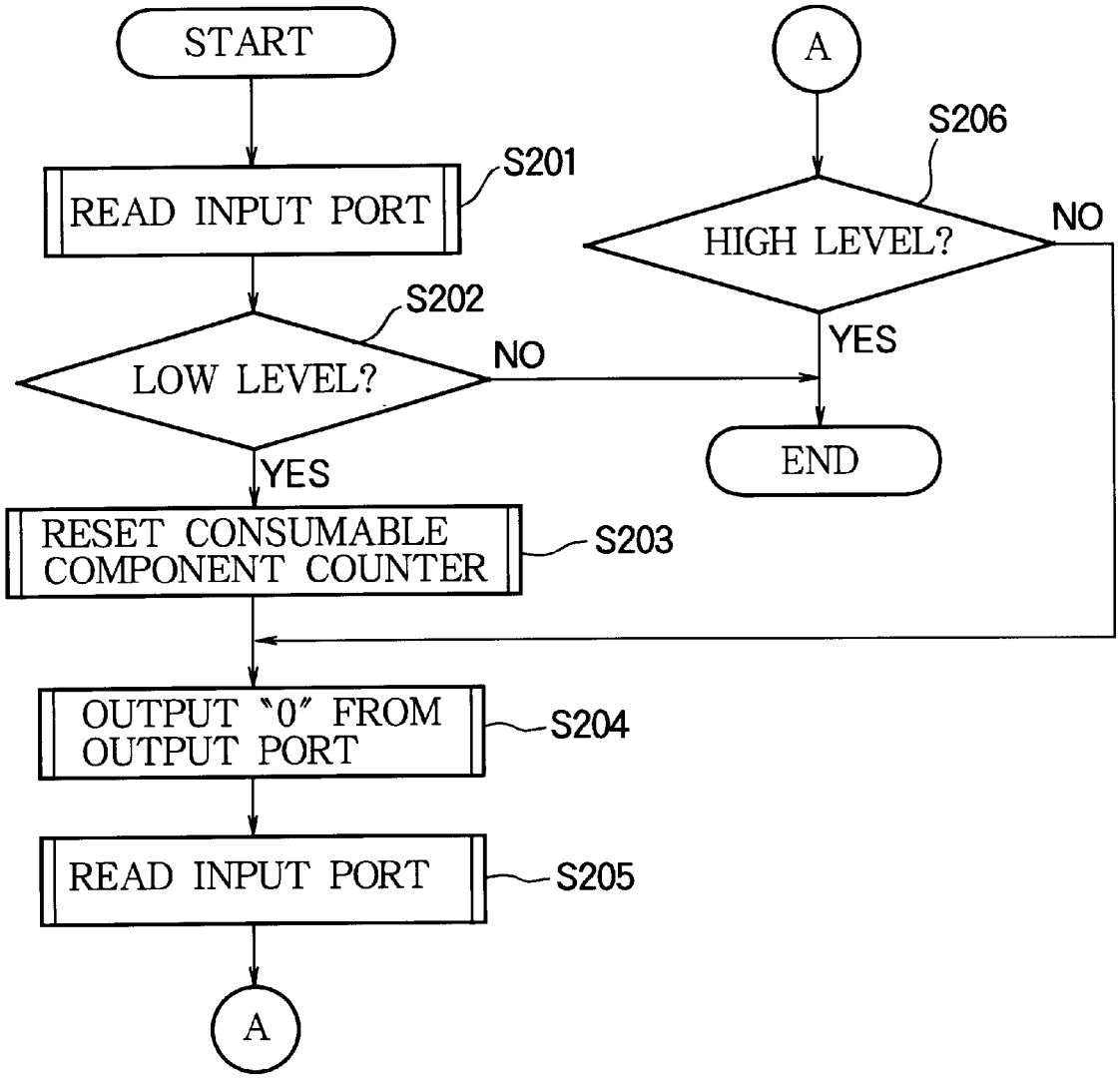
FIG. 20 is a flowchart describing the operation of the consumable-component sensing section in FIG. 19.
Figure 21:
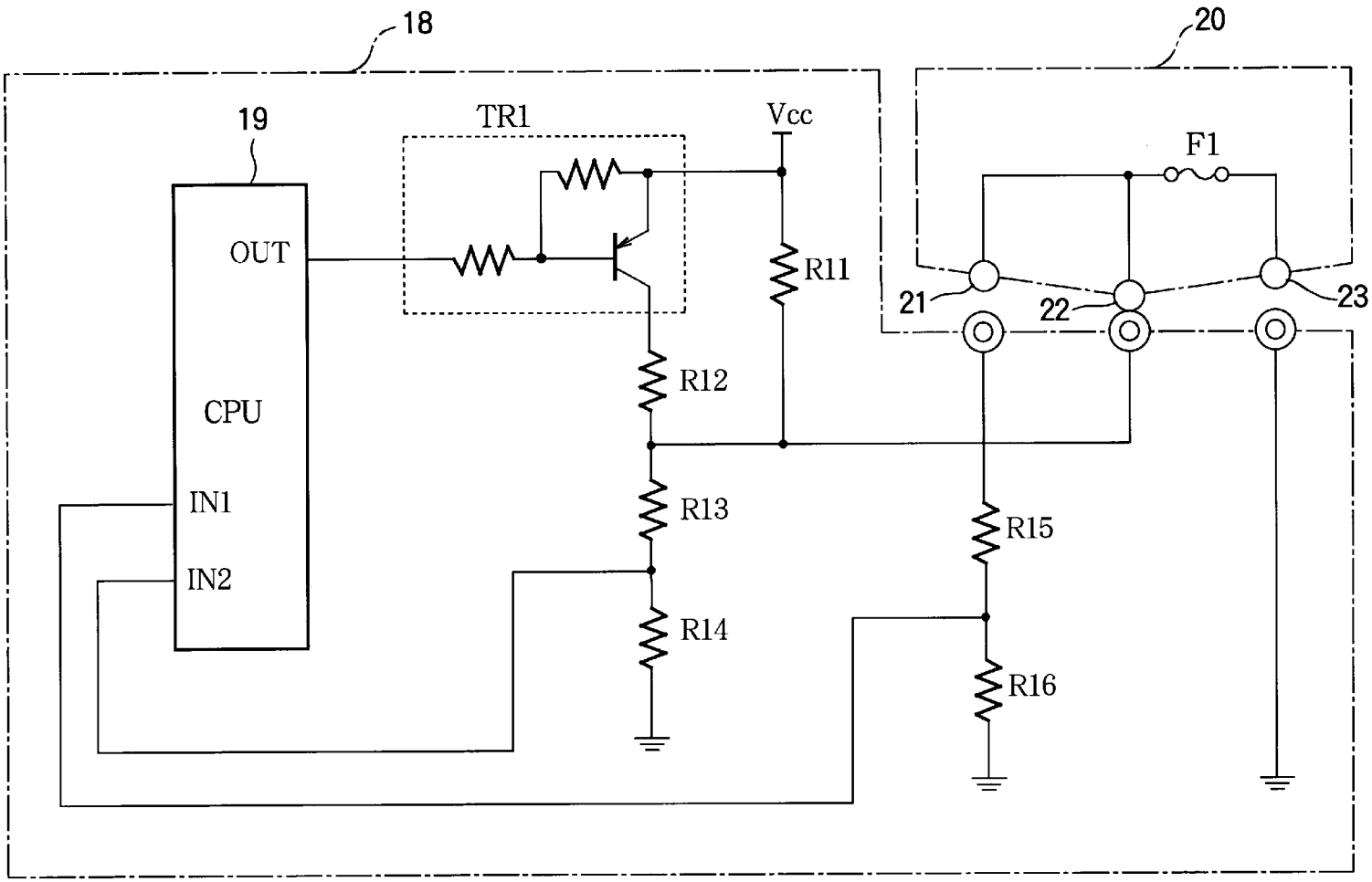
FIG. 21 is a partial circuit diagram showing the structure of another conventional consumable-component sensing section.
Figure 22:
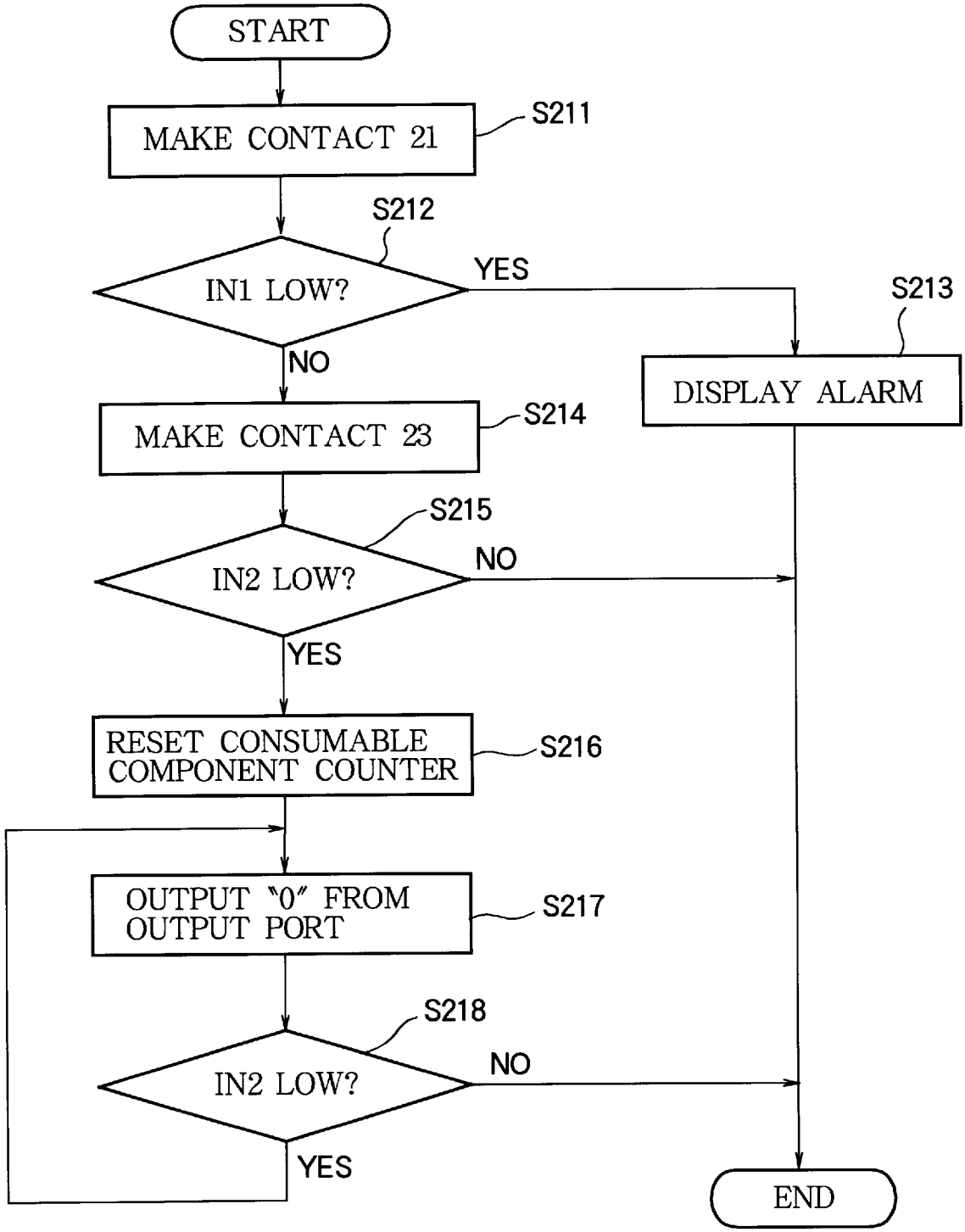
FIG. 22 is a flowchart describing the operation of the consumable-component sensing section in FIG. 21.

Next, a third embodiment will be described. The third embodiment concerns the recognition of the ID units 4*a*–7*a* in the electrophotographic printer in FIG. 17 by the consumable-component sensing section 28 or 38 in the first or second embodiment. A separate consumable-component sensing section is provided for each of the four ID units 4*a*–7*a*. In the following description, the resistances $R2_Y$, $R2_M$, $R2_C$, $R2_K$ of the resistors R2 connected in series with the internal fuses in the yellow, magenta, cyan, and black ID units 4*a*–7*a* are related so that $R2_Y > R2_M > R2_C > R2_K$. The resistances $R1_Y$, $R1_M$, $R1_C$, and $R1_K$ of resistor R1 in the corresponding consumable-component sensing sections may all be identical.

Figure 5:
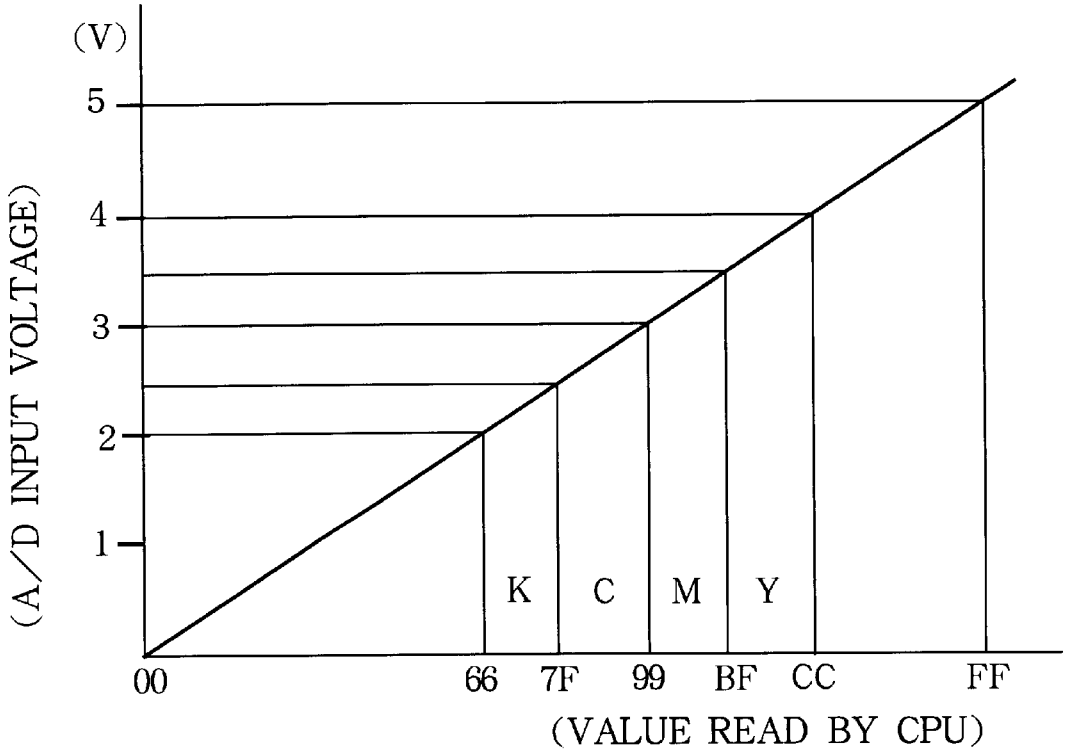
FIG. 5 is a graph illustrating the recognition of consumable components in a third embodiment of the invented image-forming device.

In FIG. 5 the voltage value of point P is indicated on the vertical axis, and the eight-bit digital value to which this voltage is converted in the CPU is indicated on the horizontal axis. These values are nominally in a different range for each of the four colors yellow (Y), magenta (M), cyan (C), and black (K). An adequate recognition margin can be obtained by setting the resistance values of R1 and R2 to generate voltage values of, for example, 3.5–4.0 V in the Y-ID unit 4*a*, 3.0–3.5 V in the M-ID unit 5*a*, 2.5–3.0 V in the C-ID unit 6*a*, and 2.0–2.5 V in the K-ID unit 7*a*. In hexadecimal notation, the corresponding ranges of the A/D-converted values are BF-CC, 99-BF, 7F-99, and 66-7F.

In the third embodiment, when an ID unit is replaced, the printer can automatically determine the color of the newly installed ID unit, and warn the user if the color is incorrect. In a tandem color electrophotographic printer, for example, the user can be specifically informed as to the position in which an ID unit of the wrong color has been installed, so that the problem can be corrected without further mistakes.

Figure 6:
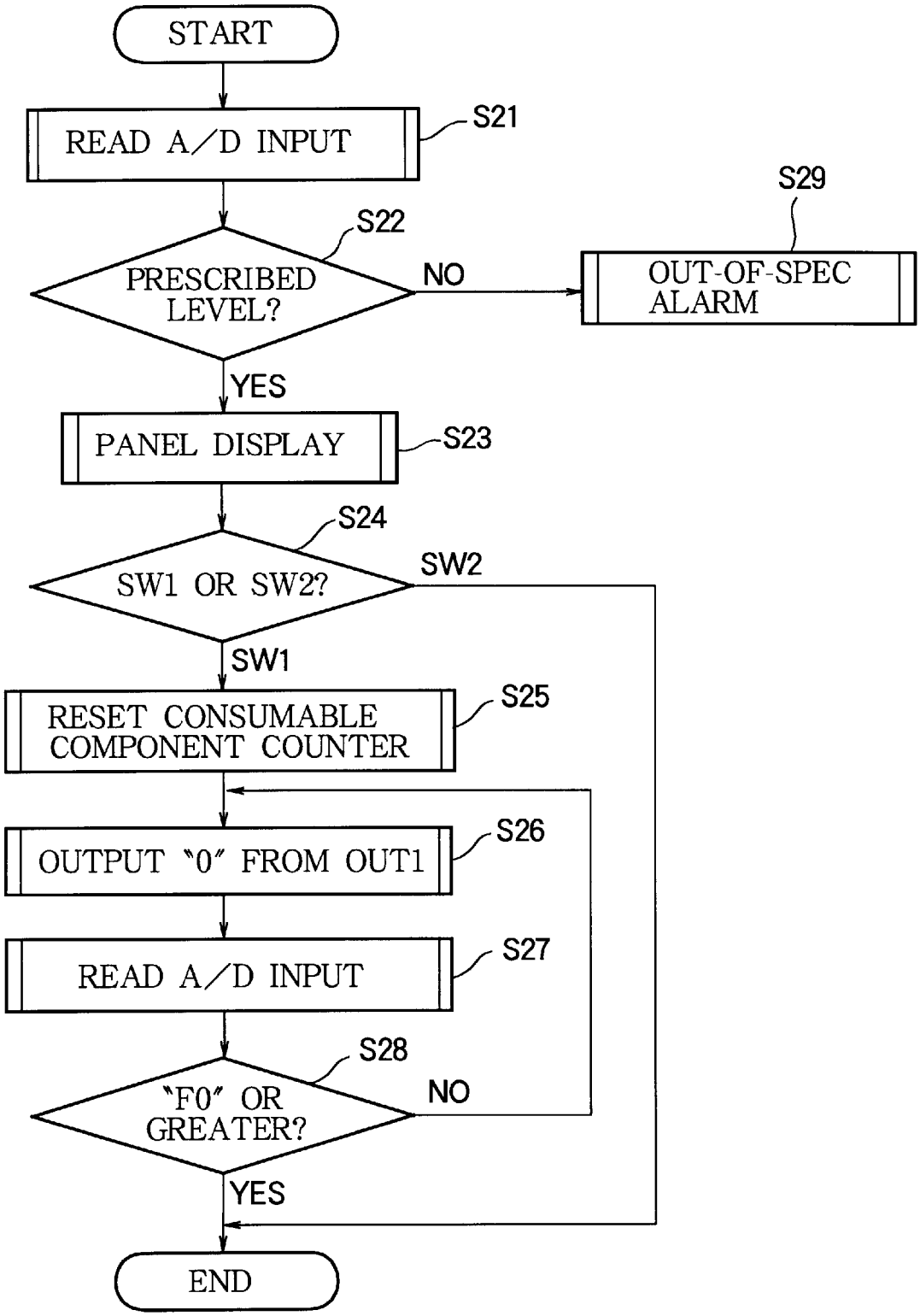
FIG. 6 is a flowchart describing the operation of a fourth embodiment of the invented image-forming device.

Next, a fourth embodiment will be described. The fourth embodiment allows the user to decide whether to blow the fuse or not when a consumable component is replaced. This feature may be added to a printer according to the first, second, or third embodiment. The operation according to the fourth embodiment will be described below with reference to the flowchart in FIG. 6.

After the replacement of a consumable component, the CPU reads the voltage of point P between resistors R1 and R2 from the analog input port (step S21). If the input value is high enough to indicate a blown fuse, the subsequent steps are skipped. Otherwise, the input value is compared with a prescribed value (step S22). If the value differs from the prescribed value, indicating that a consumable component of an incorrect type has been installed, the user is informed that the consumable component is out of specification by a control-panel display, an audible alarm, or the like (step S29). If the value is equal to the prescribed value, indicating that a new consumable component of the correct type has been installed, a query is displayed on the control panel, asking whether to reset the consumable component counter or not (step S23), and the user's response to this query is determined (step S24).

If the user does not want to reset the consumable component counter, he pushes a button that operates a switch SW2 in the printer, and the process ends. To reset the counter, the user pushes another button, operating a switch SW1, and the consumable component counter is reset (step S25). Switches SW1 and SW2 may be operated by 'Yes' and 'No' buttons on the printer's control panel.

After the reset, to blow the fuse F1, the CPU sends a '0' pulse out from output port OUT in FIG. 1 or OUT1 in FIG. 3 (step S26), switching on transistor TR1 for a certain interval. Then the CPU reads the voltage of point P from the analog input port again (step S27), and compares the A/D-converted value of the voltage with hexadecimal 'F0' (step S28) to confirm that the fuse F1 has blown. If the value now read is equal to or greater than 'F0', indicating that the fuse F1 has blown, the process ends; if the value is lower than 'F0', indicating that the fuse F1 has not blown, the process returns to step S26.

When a consumable component is manufactured, if its fuse is blown in the final functional inspection, the fuse must be replaced before shipment. In the fourth embodiment described above, the fuse need not be blown in this type of inspection, so the time, cost, and labor of replacement of the fuse can be saved. Since the user who purchases the consumable component can also select whether to blow the fuse or not, the user can install the consumable component temporarily and perform a trial printing without blowing the fuse, in order to pre-check the component for defects.

Figure 7:
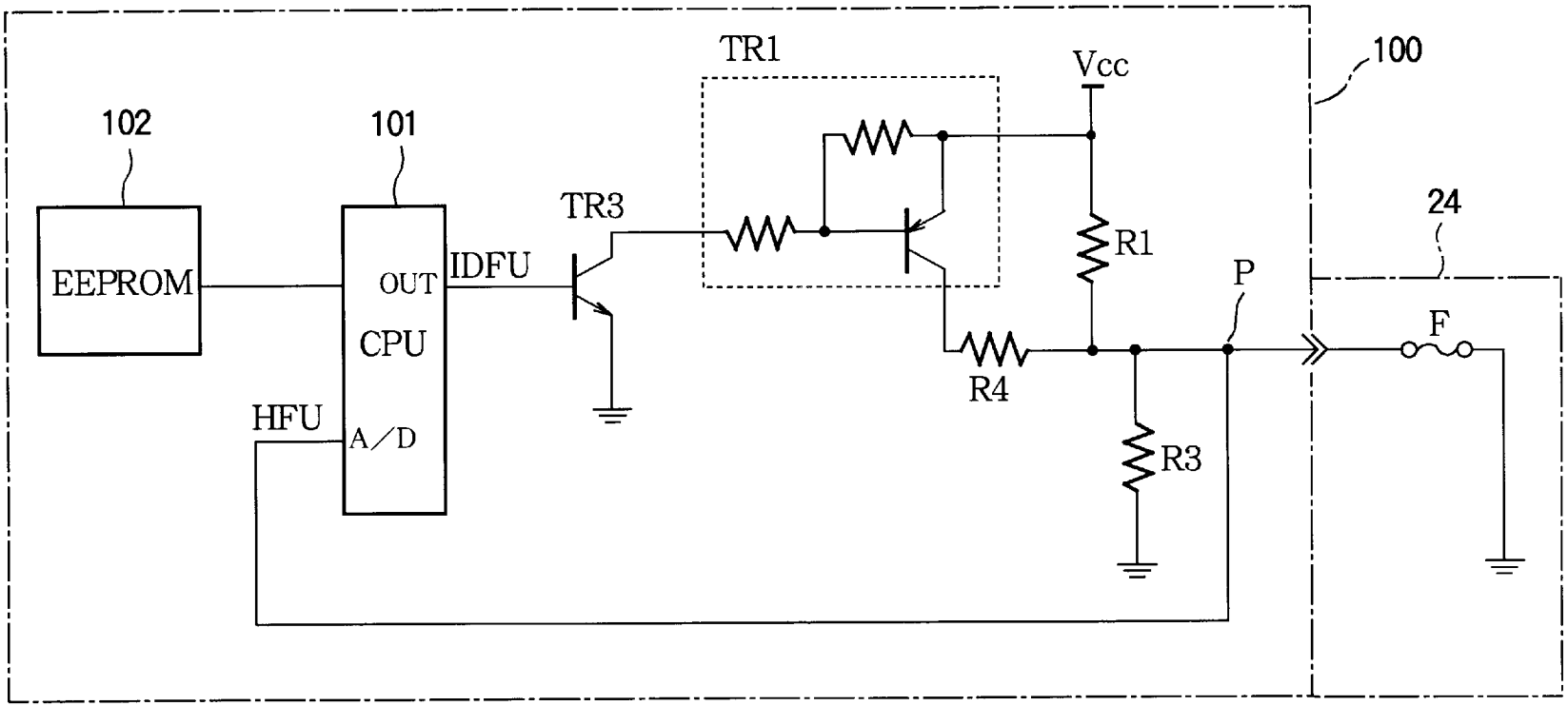
FIG. 7 is a circuit diagram showing relevant parts of a consumable component and its sensing section in a fifth embodiment of the invented image-forming device.

Next, a fifth embodiment of the invention will be described. FIG. 7 is a block diagram showing the structure of a consumable-component sensing section 100 that manages a photosensitive drum unit (ID unit) 24 in an electrophotographic printer according to the fifth embodiment.

The printer in FIG. 7 is controlled by a CPU 101, and has an electrically erasable programmable read-only memory (EEPROM) 102 storing fuse defect information, described below. The CPU 101 has an analog input port (A/D) and an output port (OUT) as in the preceding embodiments, but the output port is connected to the base of an npn bipolar transistor TR3. The emitter of transistor TR3 is connected to ground. The collector of transistor TR3 is connected to the base of pnp bipolar transistor TR1, which is similar to transistor TR1 in the preceding embodiments.

As in the preceding embodiments, transistor TR1 and a resistor R1 are coupled in parallel between a power supply Vcc and a point P. Differing from the preceding embodiments, point P is coupled to ground through a resistor R3 in the consumable-component sensing section 100, and another resistor R4 is inserted in series between point P and transistor TR1. The ID unit 24 has an internal fuse F that is coupled between point P and ground when the ID unit is installed, but does not have a resistor inserted in series between the fuse and point P.

In the drawing, fuse F is shown as grounded within the ID unit 24, but fuse F may be connected to ground in the consumable-component sensing section 100 as in the preceding embodiments.

Next, the operation of the fifth embodiment will be described. For simplicity, the resistance value of resistor R4 will be ten ohms (10 Ω), the resistance values of resistors R1 and R3 will both be twenty kilohms (20 Ω), and the power-supply voltage (Vcc) will be 5 V. The fuse F has a room-temperature resistance of 2 L and a current rating of one hundred twenty-five milliamperes (125 mA), and is specified to blow within five seconds at 200% of the rated current. The signal input at the analog input port of the CPU 101 will be denoted HFU, and the signal output from the output port will be denoted IDFU.

Figure 8:
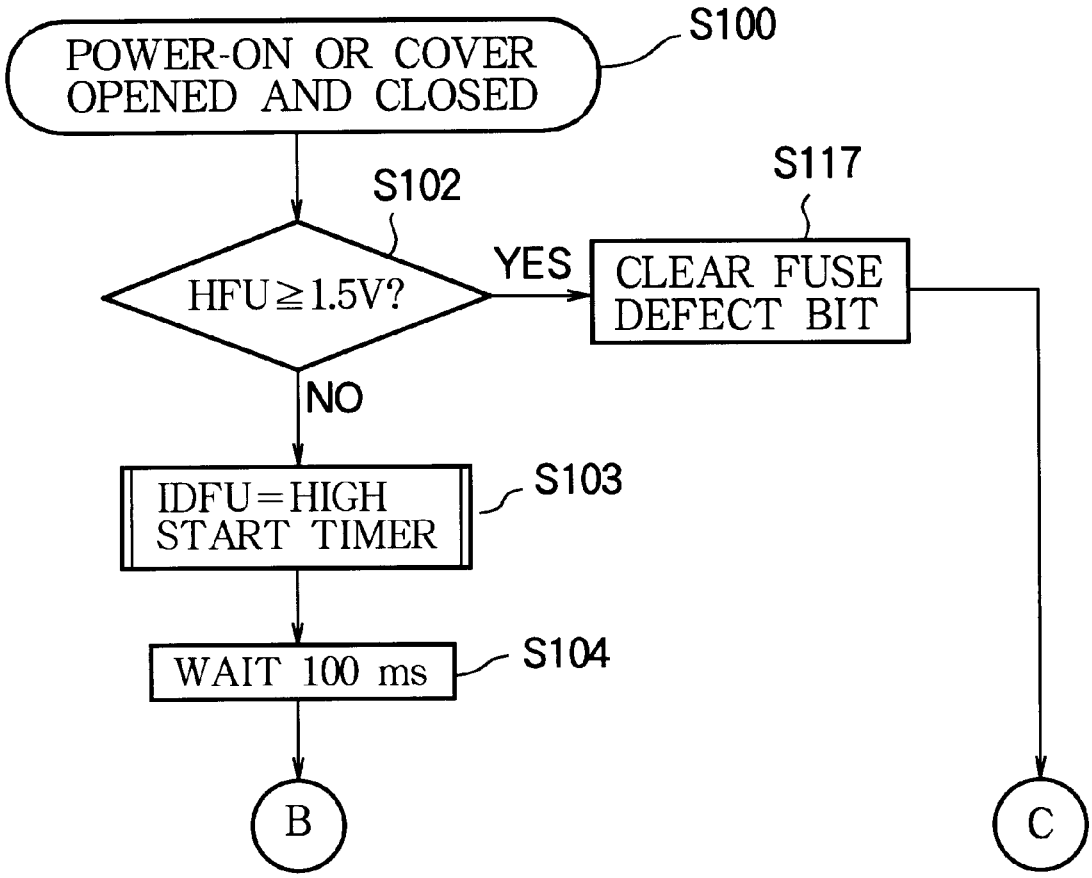
FIGS. 8 and 9 are a flowchart describing the operation of the fifth embodiment.

Referring to FIG. 8, when the printer's power is switched on or its cover (not shown) is opened and then closed (step S100), the printer begins an initial sequence of operations in preparation for printing. As part of the initial sequence, the analog input signal HFU is sampled and compared with a predetermined value of, for example, 1.5 V (step S102). Output signal IDFU is held at the low output level at this time. If the voltage of HFU is equal to or greater than the predetermined value (1.5 V), indicating that the fuse F is already blown and thus that the ID unit 24 is not a new unit, step S117 (described below) is carried out. Since resistors R1 and R3 have the same resistance value, if the fuse F is blown, the voltage at point P is approximately 2.5 V; a predetermined value of 1.5 V allows a margin for resistor tolerances.

If the HFU voltage is lower than the predetermined value, indicating that the fuse F is not blown, the CPU 101 switches output signal IDFU from the low to the high logic level, turning on transistor TR3, and at the same time starts a timer (step S103). The timer may be internal to the CPU 101, or an external timer may be used. Transistor TR3 conducts current from the base of transistor TR1, which therefore turns on, sending current from the 5-V power supply Vcc to the fuse F through resistor R4.

Since resistor R4 has much less resistance than resistor R1, the current value is determined substantially by the resistance value of resistor R4 (for simplicity, the $V_{CE}$ effect of transistor TR1 is ignored). Since the resistance value of resistor R4 is 10 Ω and the resistance value of fuse F is 2 Ω at room temperature, more than 400 mA flows through fuse F, exceeding 200% of its current rating. If fuse F is normal, it will blow within five seconds. To decide whether fuse F is normal or not, the timer outputs a trigger signal when one hundred milliseconds (100 ms) has elapsed (step S104).

Figure 9:
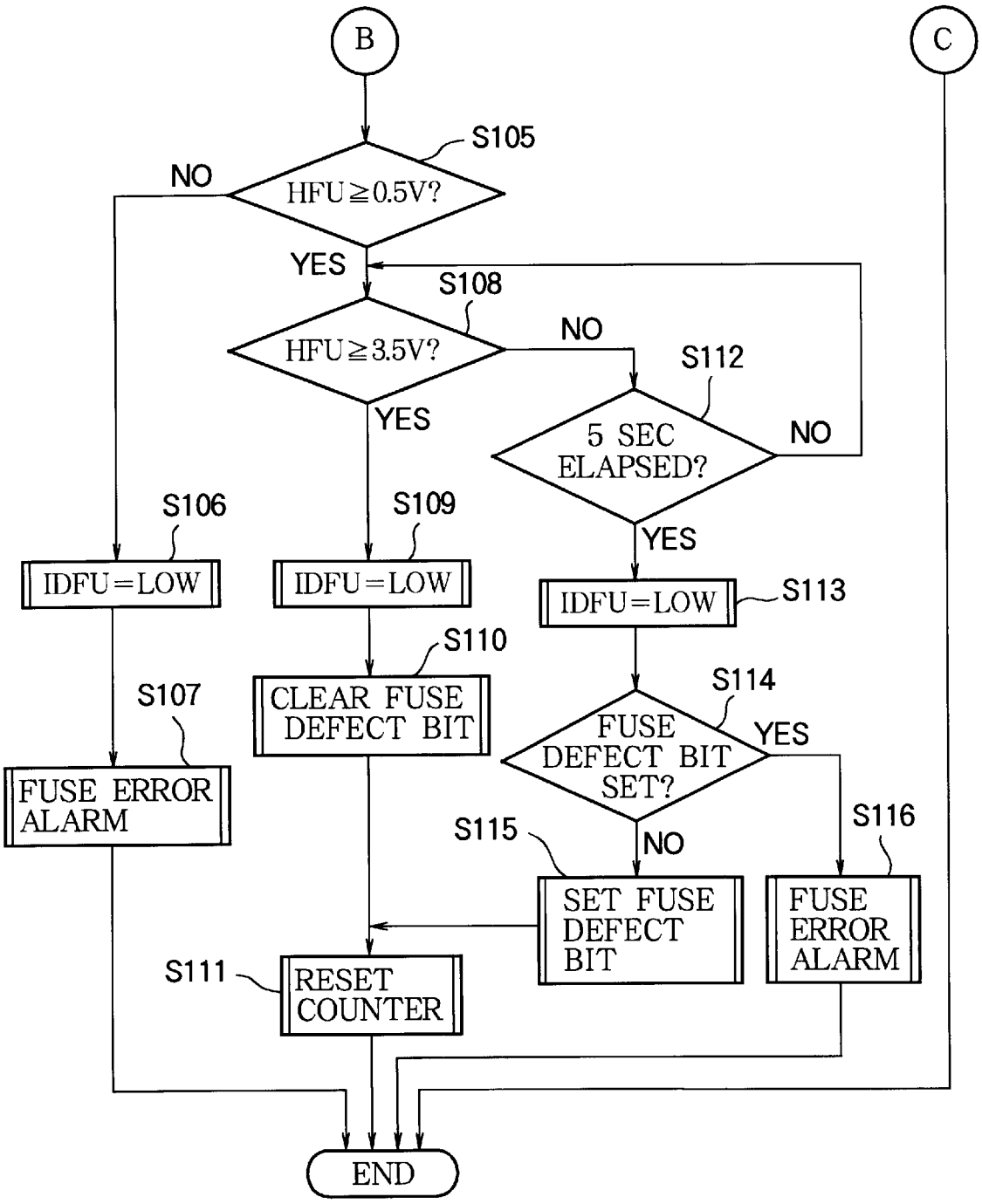

Referring to FIG. 9, on receiving the trigger signal, the CPU 101 reads the HFU voltage value again and compares it with another predetermined value, such as 0.5 V (step S105).

When current flows through a fuse, its temperature rises due to resistive heating. The increased temperature increases the resistance of the fuse, generating still more heat and raising the temperature still further, until finally the fuse blows. At room temperature the 2-Ω resistance of the fuse F should yield an HFU voltage value of approximately 0.8 V, so after 100 ms has elapsed, the voltage should exceed 0.8 V.

If the HFU voltage value after 100 ms has elapsed is found to be lower than 0.5 V in step S105, the fuse F is assumed to have too little resistance to blow, so the CPU 101 returns output signal IDFU to the low logic level (step S106), displays a fuse-error alarm warning (step S107), and terminates the initial sequence.

If the HFU voltage after 100 ms is found to be equal to or greater than 0.5 V in step S105, the fuse F is assumed to be normal, that is, to be capable of blowing. While the fuse F is blowing, the HFU voltage should rise together with the resistance of the fuse F, becoming approximately 5 V after the fuse F has blown. In step S108, the HFU voltage is monitored and compared with another predetermined value; a value of 3.5 V is used here. If the HFU voltage exceeds 3.5 V, indicating that the fuse F has blown or substantially blown, the CPU 101 returns the output signal IDFU to the low logic level (step S109), clears a fuse defect bit in the EEPROM 102 (step S110), resets the counter that measures the service life of the ID unit 24 (step S111), and proceeds with other parts of the initial sequence (not shown).

If the HFU voltage value is less than 3.5 V in step S108, the elapsed time is compared with five seconds (step S112). If the elapsed time is less than five seconds, step S108 is repeated. The CPU 101 loops between steps S108 and S112, continuously monitoring the HFU voltage (the voltage at point P) until it reaches or exceeds 3.5 V, or until five seconds have elapsed.

If the HFU voltage value has not reached 3.5 V by the time five seconds have elapsed, the fuse F is assumed to have failed to blow, and the CPU 101 returns output signal IDFU to the low logic level (step S113). Next, the CPU 101 checks the fuse defect bit in the EEPROM 102 (step S114). If the fuse defect bit is in the cleared state, it can be inferred that the ID unit 24 is a newly installed unit. The CPU 101 now sets the fuse defect bit (step S115), resets the counter (step S111), and terminates the processing. If the fuse defect bit is found to be already set in step S114, indicating that the fuse F also failed to blow the last time this process was performed, the CPU 101 does not reset the counter, displays a fuse error alarm (step S116), and terminates the initial sequence.

If the ID unit 24 has a blown fuse, as determined in step S102 in FIG. 8, indicating that the ID unit 24 is not new, the CPU 101 clears the fuse defect bit in the EEPROM 102 (step S117) and proceeds with other parts of the initial sequence (not shown) without resetting the counter.

In the fifth embodiment, when a new ID unit 24 with a non-blown fuse F is installed, if the fuse F does not have an abnormally low resistance, the counter that keeps track of the service life of the ID unit 24 is reset automatically, and an attempt is made to blow the fuse F. If the attempt fails, this is recorded by setting the fuse defect bit in the EEPROM 102, and a second attempt is made the next time the printer's power is switched on or its cover is opened and closed. If the second attempt to blow the fuse succeeds, the fuse defect bit is cleared and normal use of the ID unit 24 continues. If the second attempt also fails, the fuse F is considered defective and a fuse error alarm is indicated.

Various actions can be taken in response to the fuse error alarm. For example, the user may replace the ID unit 24, or continue to use the ID unit 24 but be alert for possible printing quality problems later, since the counter may not indicate the service life of the ID unit 24 correctly. In any case, the fifth embodiment enables an ID unit with a defective fuse to be used at least once before being discarded.

Figure 10:
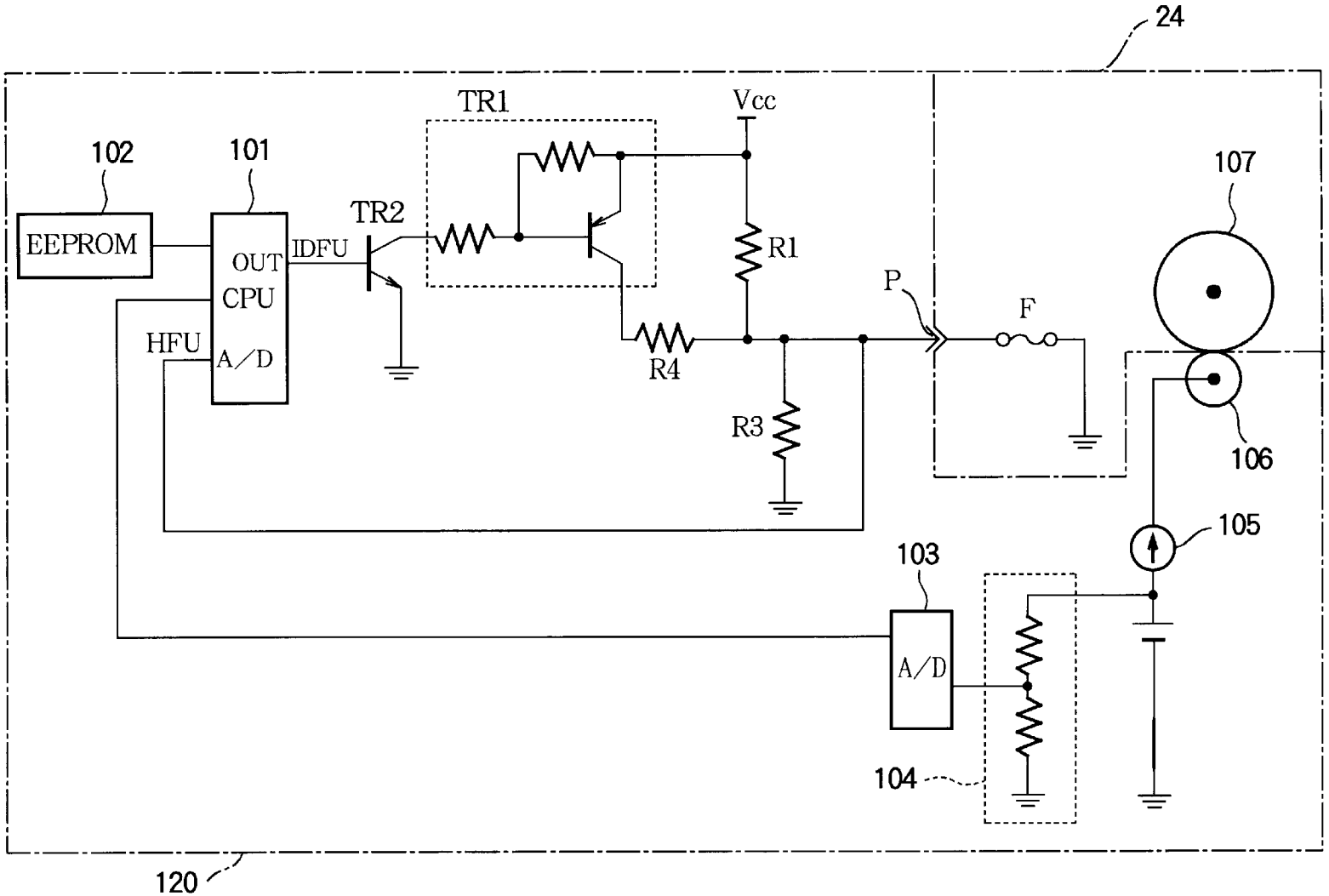
FIG. 10 is a circuit diagram showing relevant parts of a consumable component and its sensing section in a sixth embodiment of the invented image-forming device.

Next, a sixth embodiment of the invention will be described. FIG. 10 is a block diagram showing the structure of the consumable-component sensing section 120 of a printer according to the sixth embodiment. The sixth embodiment adds an A/D converter 103 and a voltage-dividing circuit 104 to the structure of the fifth embodiment. The voltage-dividing circuit 104 divides a transfer voltage output by a high-voltage power source 105 to a transfer roller 106 that faces the photosensitive drum 107 in the ID unit 24. The divided transfer voltage is converted to digital form by the A/D converter 103 and supplied to the CPU 101. Alternatively, the divided transfer voltage may be supplied directly to an analog input port of the CPU 101.

Figure 11:
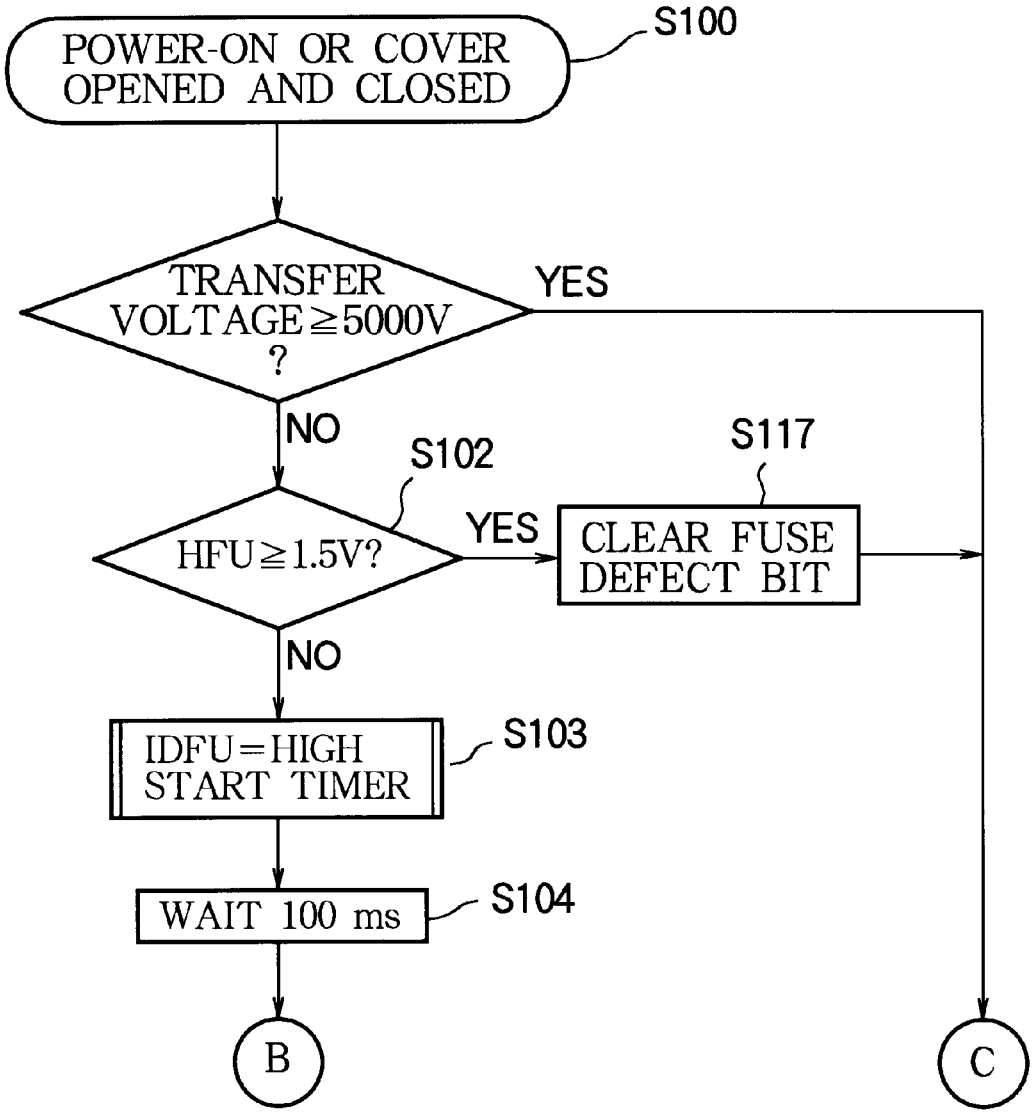
FIGS. 11 and 12 are a flowchart describing the operation of the sixth embodiment.
Figure 12:
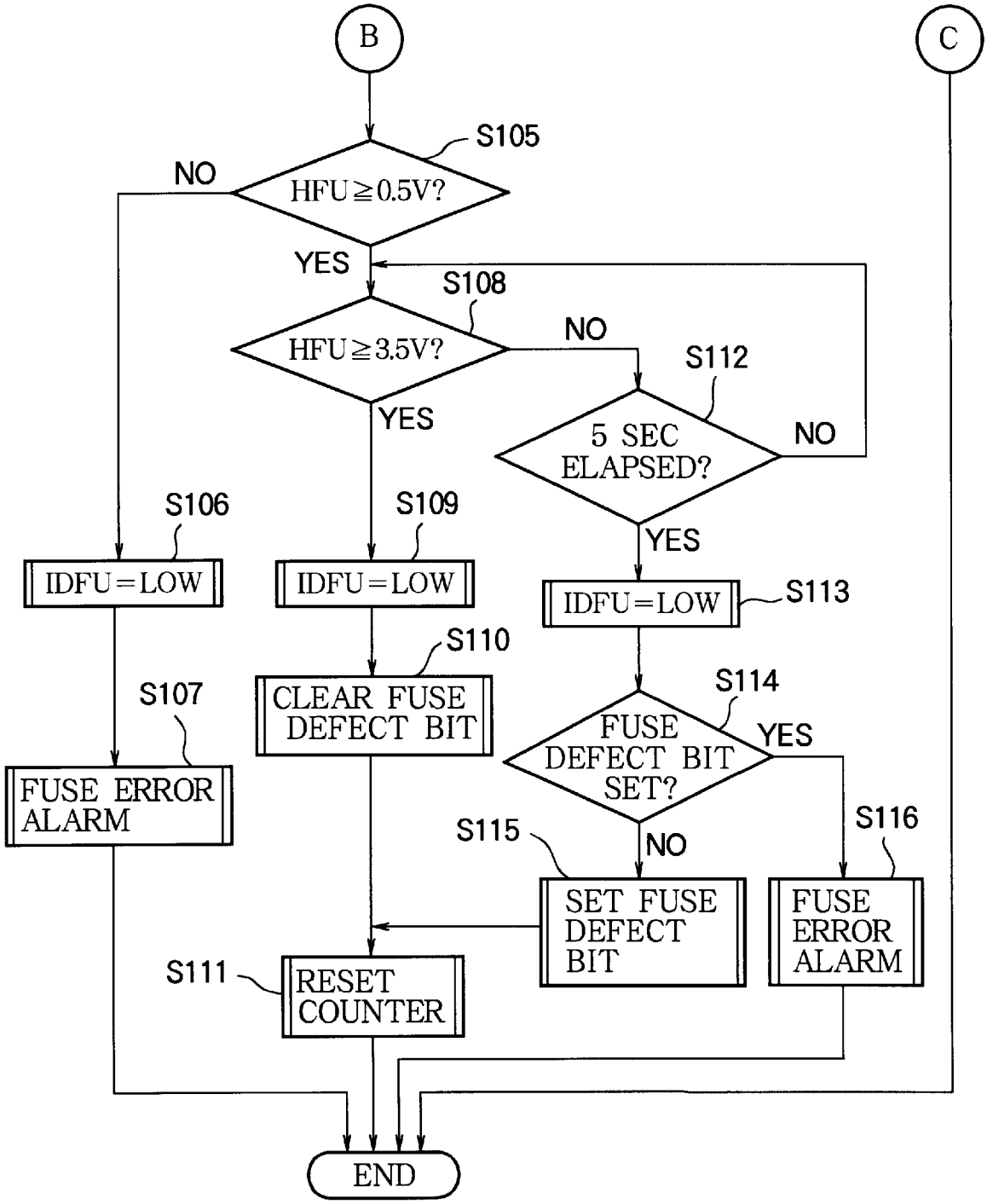

The operation of the sixth embodiment will be described with reference to the flowchart in FIGS. 11 and 12, assuming the same resistance values and fuse specifications as in the fifth embodiment. This flowchart differs from the flowchart in the fifth embodiment in that step S101 is inserted between steps S100 and S102.

When the printer's power is switched on or its cover is opened and closed (step S100), as part of the initial sequence, the CPU 101 activates the motor (not shown) that rotates the photosensitive drum 107 in the ID unit 24, and controls the high-voltage power source 105 so as to charge the photosensitive drum 107 to a fixed potential. During these operations, the high-voltage power source 105 operates as a constant-current source, and the CPU 101 monitors the transfer voltage to determine whether the transfer roller 106 and photosensitive drum 107 are in contact and rotating or not. The reason why this can be determined is as follows.

The surface of the photosensitive drum 107 is coated with a photosensitive substance, forming a photosensitive layer, the resistance value of which decreases under optical illumination. While being charged in the initial sequence, the photosensitive drum is not illuminated, so it acts substantially as a capacitor, storing charge on the surface of the photosensitive layer. The charge is supplied as current from the high-voltage power source 105 through the resistance of the transfer roller 106, provided the photosensitive drum 107 and transfer roller 106 are in contact. If the photosensitive drum 107 is rotating, the current keeps flowing at a substantially constant rate, as new areas of the surface of the photosensitive drum 107 are continuously brought into contact with the transfer roller 106, without requiring any change in the transfer voltage output by the high-voltage power source 105.

The value of the transfer voltage during this initial operation depends on the control value of the current, the rotational speed of the photosensitive drum, and the resistance value of the transfer roller. A maximum transfer voltage of approximately 4000 V has been experimentally confirmed in a printer according to the present embodiment.

If the printer begins the initial sequence in the state in which the ID unit 24 is not installed, since there is no photosensitive drum 107, no current can flow from the high-voltage power source 105. Since the high-voltage power source 105 is being controlled for constant-current output, however, it attempts to generate current by increasing the transfer voltage to the maximum possible value, which in the present embodiment is approximately 8000 V.

If the photosensitive drum is installed but is not rotating, then as the area of the photosensitive drum 107 in contact with the transfer roller 106 becomes increasingly charged, it becomes increasingly difficult for more current to flow. To maintain a constant current flow, the high-voltage power source 105 must generate an increasingly high transfer voltage. After a certain time, the transfer voltage again reaches the maximum value of approximately 8000 V.

Thus by monitoring the transfer voltage during the initial operation of the printer, the CPU 101 can determine whether the ID unit 24 is properly installed, so that the transfer roller 106 and photosensitive drum 107 make contact, and whether the photosensitive drum 107 is rotating or not. In step S101 in the flowchart in FIG. 11, the CPU 101 compares the value received from the A/D converter 103 with a predetermined value representing a transfer voltage of 5000 V (prior to voltage division by the voltage-dividing circuit 104). If the transfer voltage is lower than 5000 V, indicating that the ID unit 24 is properly installed and its photosensitive drum 107 is rotating, the process proceeds to step S102 and continues through FIGS. 11 and 12 as in the fifth embodiment.

If a transfer voltage equal to or greater than 5000 V is detected in step S101, however, the ID unit 24 is determined not to be installed, or to have a non-rotating photosensitive drum 107, and the CPU 101 terminates the initial sequence without resetting the counter. This prevents the fuse defect bit from being mistakenly cleared in step S117. It also prevents mistaken resetting of the counter in step Sill and mistaken clearing of a service-life alarm, which might otherwise occur through an incorrect or illegal operation.

The fifth and sixth embodiments can be modified in various ways. For example, the fuse defect bit can be checked before being cleared in step S110. If the fuse defect bit is set at this point, then after it is cleared in step S110, the resetting of the counter in step S111 can be skipped.

Figure 13:
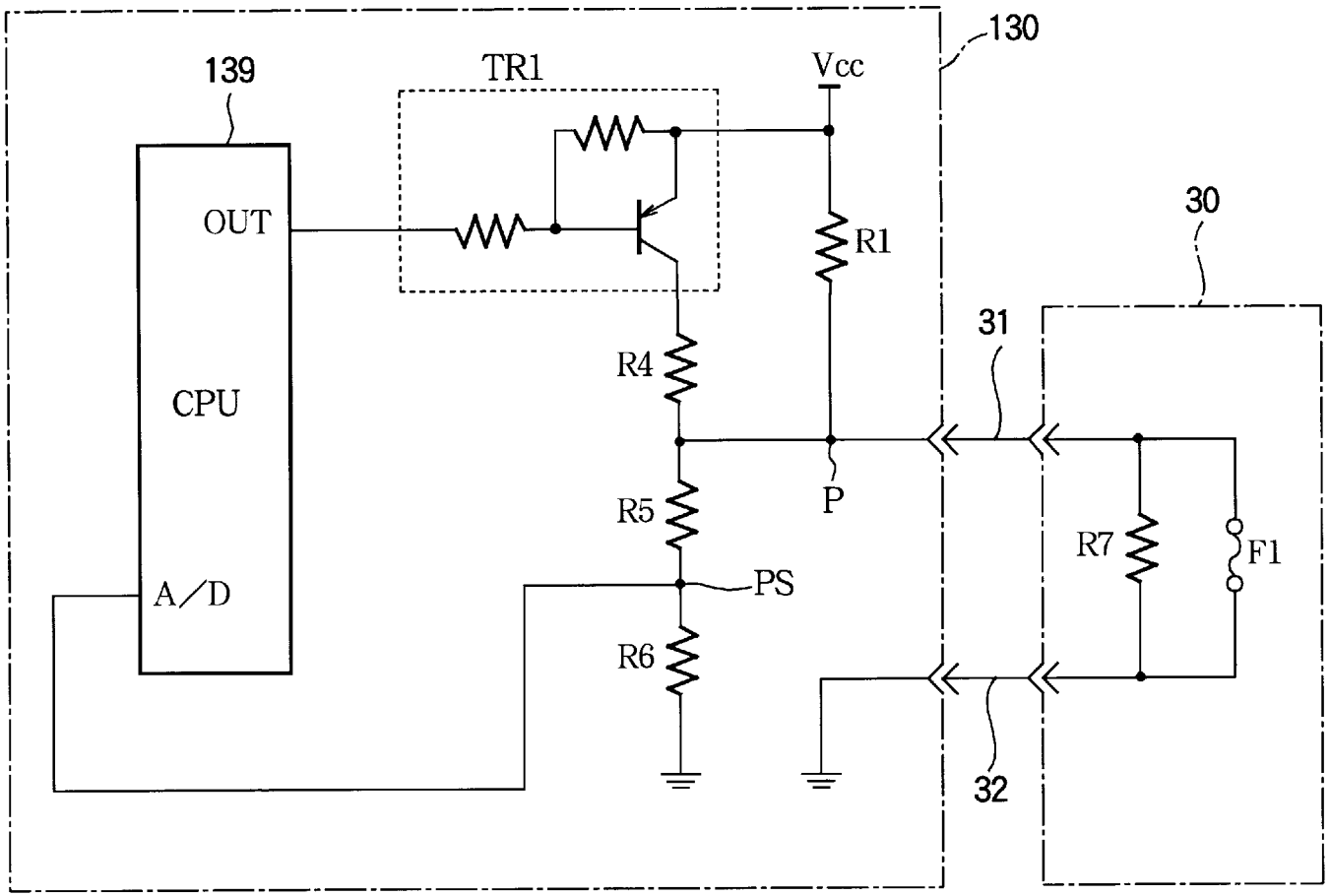
FIG. 13 is a circuit diagram showing relevant parts of a consumable component and its sensing section in a seventh embodiment of the invented image-forming device.

Next, a seventh embodiment of the invention will be described. FIG. 13 is a block diagram showing the structure of a consumable component 30 and the consumable-component sensing section 130 that manages it in the seventh embodiment.

The consumable-component sensing section 130 includes a CPU 139 with an analog input port (A/D) having an analog-to-digital conversion function and an output port (OUT). The output signal from the output port controls a transistor TR1 that is coupled in parallel with a resistor R1 between a power supply (Vcc) and a point P, an additional resistor R4 being inserted in series between transistor TR1 and point P. A further pair of resistors R5 and R6 are coupled in series between point P and ground. The analog input port of the CPU 139 is connected to a point PS between resistors R5 and R6.

The consumable component 30 makes electrical contact with the consumable-component sensing section 130 at two points 31, 32, one coupled to point P, the other coupled to ground. In the consumable component 30, a fuse F1 and a resistor R7 are connected in parallel between the two electrical contact points 31, 32.

The resistance value of resistor R7 varies depending on the type and specifications of the consumable component 30, but is high enough to enable the fuse F1 to be blown. Resistors R1, R5, and R6 also have comparatively high resistance values, while resistor R4 has a comparatively low resistance value.

If the consumable component 30 is not installed, the A/D input value corresponds to the power-supply voltage Vcc divided at point PS by the resistances of resistors R1, R5, and R6. If the consumable component 30 is installed and fuse F1 is blown, the A/D input will have a lower value, since the resistance between point P and ground is reduced by the parallel path through resistor R7. This lower value will vary depending on the resistance of resistor R7, thus on the type and specifications of the consumable component 30. If the consumable component 30 is installed and its fuse F1 is not blown, point P is pulled down substantially to ground level through the fuse F1, so the A/D input value is substantially zero.

The operation of the seventh embodiment will be described with reference to the flowchart in FIG. 14.

When the printer's power is switched on or a cover (not shown) is opened and then closed, the CPU 139 reads the A/D-converted input value at the analog input port, representing the voltage at point PS (step S121), and compares it with a first predetermined value, such as hexadecimal '10', representing a voltage close to ground level (step S122). If the A/D input value is less than this first predetermined value, indicating that the consumable component 30 is installed and its fuse has not yet been blown, the CPU 139 resets the counter that manages the service life of the consumable component (step S123), then sends a '0' pulse out from the output port OUT (step S124), switching on transistor TR1 for a certain interval to blow the fuse F1. Next, the CPU 139 reads the A/D input again (step S125), compares it with the first predetermined value (step S126), and returns to step S124 if the input value is still less than the first predetermined value. Steps S124 to S126 are repeated until the A/D input value becomes equal to or greater than the first predetermined value, indicating that fuse F1 has blown, or until a limit number of repetitions is reached. If fuse F1 does not blow within the limit number of repetitions, the CPU 139 generates a fuse error alarm, although this is not indicated in the drawing.

When the A/D input becomes equal to or greater than the first predetermined value (e.g., '10') in step S126, the CPU 139 compares the A/D input value with a prescribed value that should be obtained if the correct type of consumable component 30 is installed and resistor R7 has the prescribed resistance value (step S127). If the A/D input reveals that resistor R7 does not have the prescribed resistance value, an out-of-specification alarm is generated (step S128). If resistor R7 has the prescribed resistance value, the procedure ends.

If the A/D input value is equal to or greater than the first predetermined value in step S122, it is compared with a second predetermined value such as hexadecimal '80' (step S129). The second predetermined value is greater than any A/D input value that should be obtained if the consumable component 30 is installed, but less than the A/D input value obtained when the consumable component 30 is not installed. If the A/D input value is less than this second predetermined value, then step S127 is carried out to decide whether resistor R7 has the prescribed resistance value. If the A/D input value is equal to or greater than the second predetermined value, the user is informed by a control-panel display, an audible alarm, or the like that the consumable component 30 is not installed (step S130).

By reading the A/D input value, the CPU 139 indirectly measures the resistance between the electrical contact points 31, 32. From this resistance measurement, the CPU 139 can determine whether the consumable component 30 is installed or not; if installed, whether its fuse F1 is blown or not; and if the fuse is blown, and whether the consumable component 30 is of the correct type or not.

Figure 14:
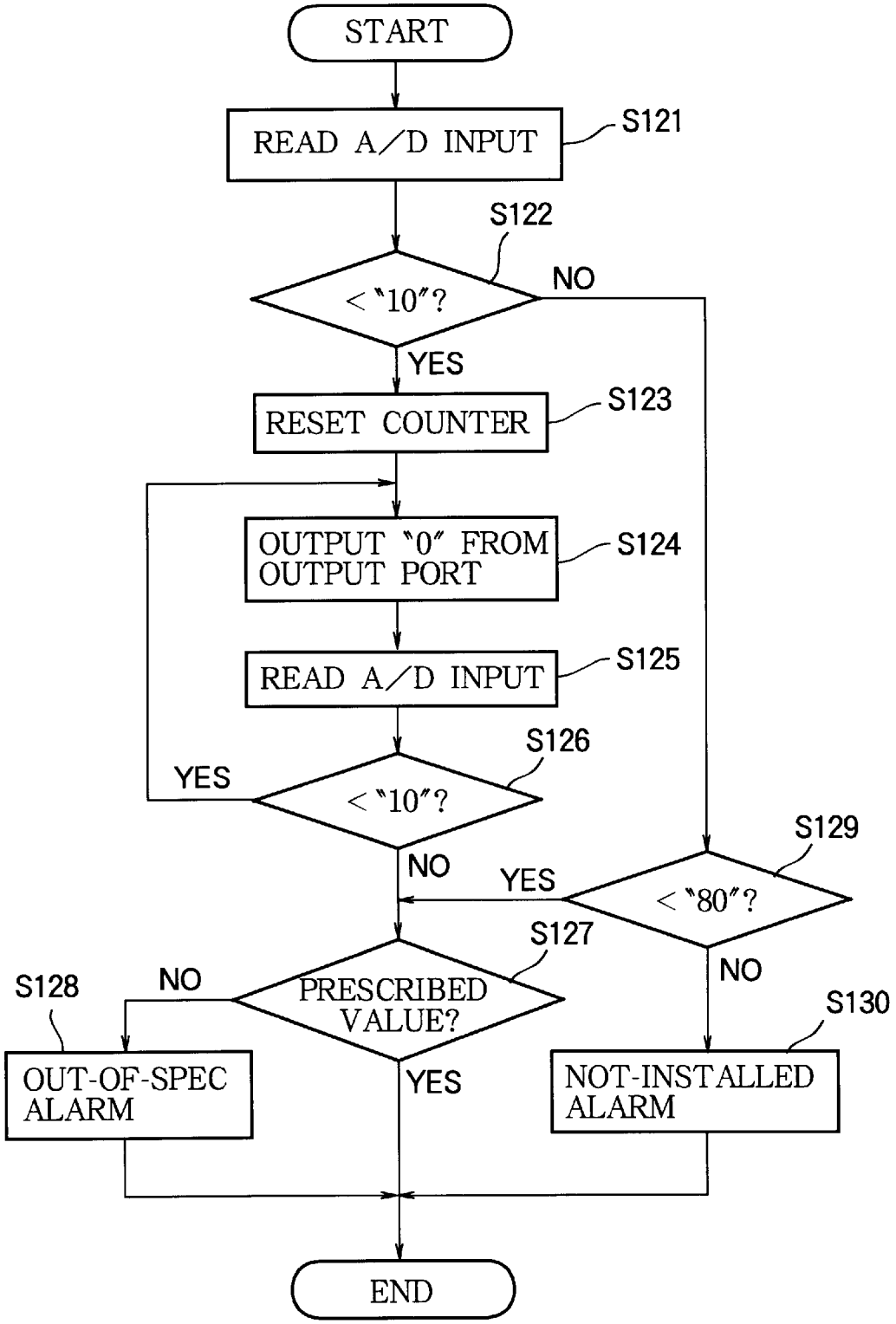
FIG. 14 is a flowchart describing the operation of the seventh embodiment.

The procedure shown in FIG. 14 can be modified in various ways. For example, the A/D input value can be compared with the second predetermined value before being compared with the first predetermined value.

Figure 15:
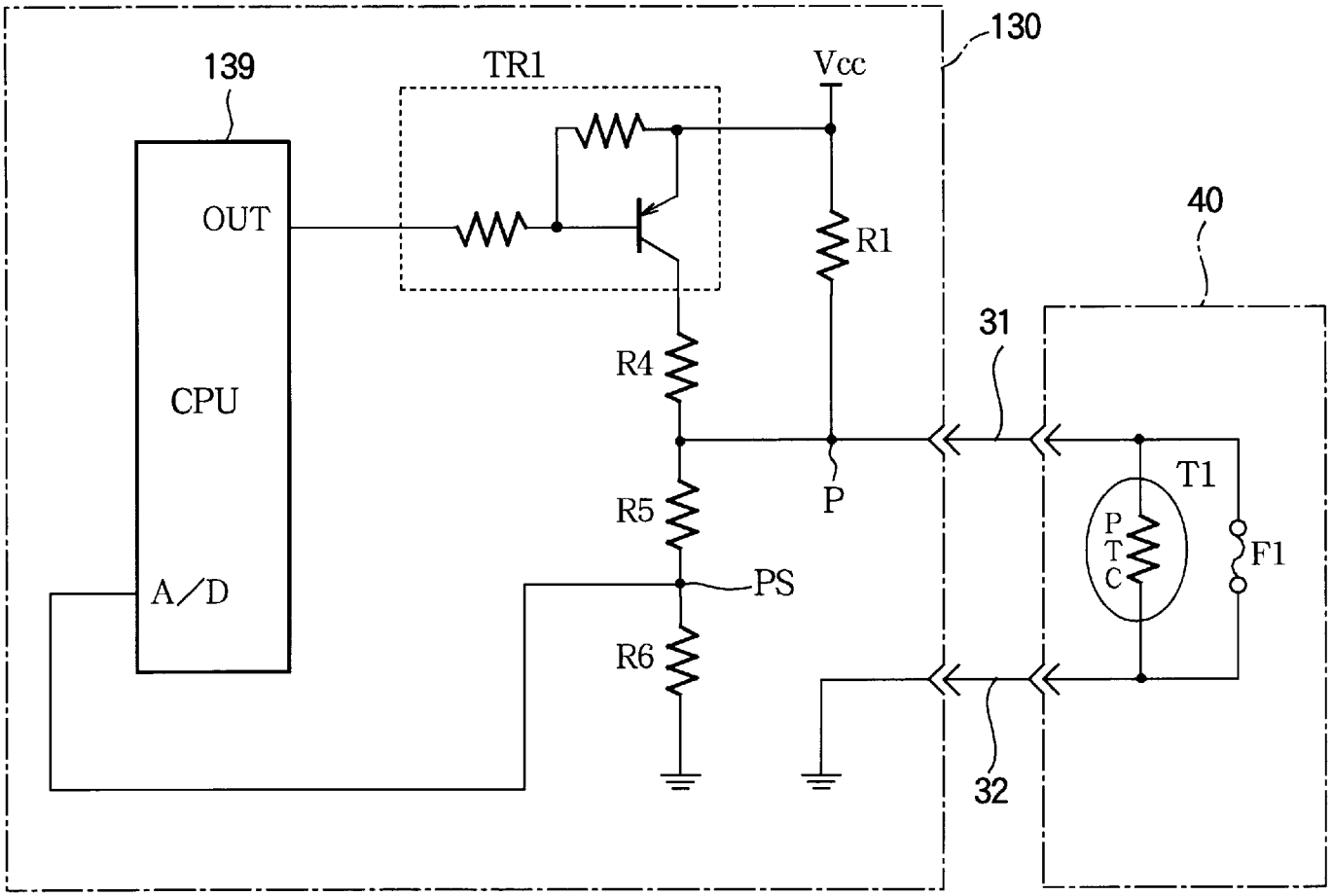
FIG. 15 is a circuit diagram showing relevant parts of a consumable component and its sensing section in an eighth embodiment of the invented image-forming device.

Next, an eighth embodiment of the invention will be described. FIG. 15 is a block diagram showing the structure of a consumable component 40 and the consumable-component sensing section 130 that manages it in the eighth embodiment.

The consumable-component sensing section 130 in the eighth embodiment is substantially identical to the consumable-component sensing section in the seventh embodiment. The consumable component 40 has a positive-temperature-coefficient (PTC) thermistor T1 coupled in parallel with the internal fuse F1. The PTC thermistor T1 is a type of resistor having a resistance that increases rapidly as its temperature rises.

At room temperature, the resistance of the PTC thermistor T1 is less than the resistance of resistor R7 in the seventh embodiment. Consequently, there is a greater difference between the potential at point PS when the consumable component 40 is installed and the potential at point PS when the consumable component 40 is not installed than in the seventh embodiment, making the installed state easier to distinguish from the not-installed state.

When transistor TR1 is turned on to blow the fuse F1, initially, less current flows through fuse F1 than in the seventh embodiment, because more current is shunted through the PTC thermistor T1, but resistive heating quickly causes the resistance of the PTC thermistor T1 to rise to a value higher than the resistance of resistor R7 in the seventh embodiment. More current then flows through fuse F1 than in the seventh embodiment, so fuse F1 is blown more effectively than in the seventh embodiment.

After the fuse F1 has been blown, the temperature dependence of the resistance of the PTC thermistor T1 can be used to monitor the temperature in the consumable component 40.

Figure 16:
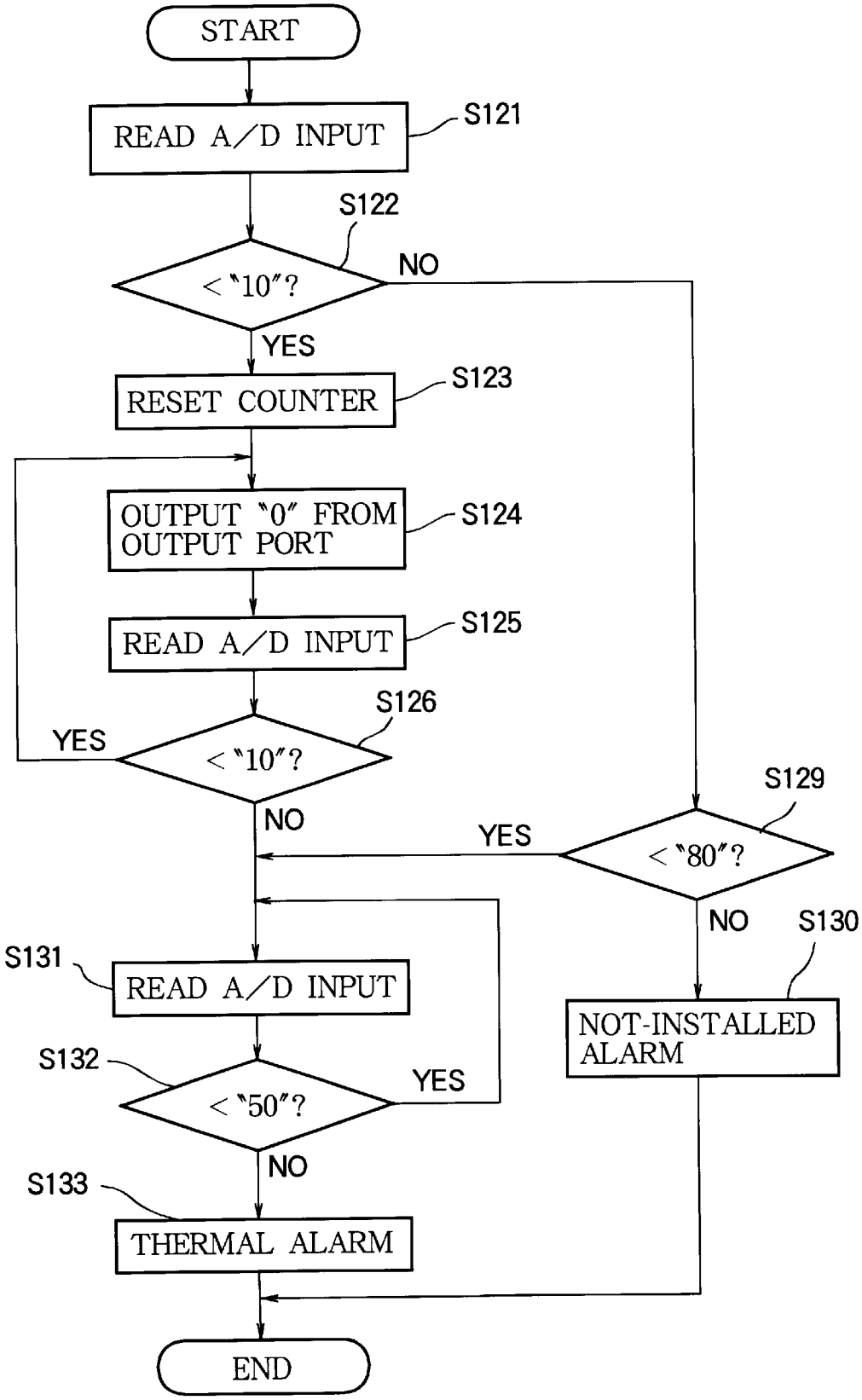
FIG. 16 is a flowchart describing the operation of the eighth embodiment.

The operation of the eighth embodiment will be described below with reference to the flowchart in FIG. 16. Steps S121 to S126, S129, and S130 are identical to the corresponding steps in the seventh embodiment (FIG. 14), so descriptions of these steps will be omitted.

If the A/D input value is greater than the first predetermined value ('10') in step S126 or less than the second predetermined value ('80') in step S129, indicating in either case that the consumable component 40 is installed and the fuse F1 is blown, the CPU 139 leaves transistor TR1 switched off and begins monitoring the printer's temperature by reading the A/D input value (step S131) and comparing it with a third predetermined value (step S132).

Since transistor TR1 is turned off, the current flowing through the PTC thermistor T1 is limited by the comparatively large resistance of resistor R1. Resistive heating is therefore slight, the temperature and resistance of the PTC thermistor T1 are comparatively low, and the A/D input value is correspondingly low. The third predetermined value is selected so that if the temperature inside the printer is normal, the A/D input will be below the third predetermined value, and if the temperature rises to an unsafe level, the resulting increase in the resistance of the PTC thermistor T1 will raise the A/D input above the third predetermined value. In the drawing, the third predetermined value is hexadecimal '50', although of course this value is only shown as an example.

If the A/D input value is less than the third predetermined value in step S132, the CPU 139 takes no particular action, but repeats steps S131 and S132 at suitable intervals thereafter to continue monitoring the printer's temperature. If the A/D input value is equal to or greater than the third predetermined value in step S132, the CPU 139 issues a thermal alarm (step S133) and disables further use of the printer until the A/D input value is reduced below the third predetermined value.

By connecting a PTC thermistor instead of a resistor in parallel with the fuse F1, the eighth embodiment both facilitates the blowing of the fuse and provides a convenient way to monitor the printer's temperature, thereby improving the safety of the printer.

Although various types of PTC thermistors may be used in the eighth embodiment, a polymer PTC thermistor is preferable, because this type of thermistor has a large positive temperature coefficient and responds quickly to temperature changes. Use of a polymer PTC thermistor thus enables the fuse F1 to be blown rapidly and reliably, and also enables temperature changes in the printer to be detected quickly and sensitively.

In the preceding embodiments, the analog voltage at point P (or PS) was converted to, for example, an eight-bit digital value, but it is also possible to employ comparators that compare the analog voltage with various preset threshold voltages or slice levels, and output one-bit signals indicating whether the analog voltage is above or below the corresponding slice levels. These one-bit signals can be received at digital input ports of the CPU.

In any of the preceding embodiments, when a service-life alarm is displayed to indicate the need for replacement of the consumable component, the service-life alarm may be cleared at the point at which the counter is reset.

Although the present invention has been described in relation to a tandem color electrophotographic printer, it can also be practiced in a monochrome electrophotographic printer, in electrophotographic printers used as components in other image-forming devices such as photocopiers and facsimile machines, and more generally in any type of device having a consumable component.

A few variation of the above embodiments have been mentioned, but those skilled in the art will recognize that further variations and modifications are possible within the scope of the appended claims.

What is claimed is:

1. An image-forming device comprising a consumable component including at least a fuse and an indicating section indicating whether the consumable component is new or not new and the type of the consumable component; and a sensing section that senses whether the consumable component is new or not new and the type of consumable component indicated by the indicating section before the fuse is blown.

2. The image-forming device of claim 1, wherein the image-forming device is an electrophotographic printer.

3. The image-forming device of claim 1, wherein the sensing section includes:

a second resistor connected in series with the first resistor when the consumable component is installed; and a processing unit for measuring a voltage at a point between the first resistor and the second resistor.

4. The image-forming device of claim 3, wherein the sensing section also includes a transistor connected in parallel with the second resistor, for blowing the internal fuse in the consumable component.

5. The image-forming device of claim 1, further comprising means for short-circuiting the internal fuse in the consumable component to measure the resistance of the first resistor after the internal fuse is blown.

6. The image-forming device of claim 5, wherein said means for short-circuiting comprises a transistor coupled in parallel with the internal fuse.

7. The image-forming device of claim 1, the consumable component being a photosensitive drum unit with toner, wherein the first resistor has different resistance values for different toner colors.

8. The image-forming device of claim 7, wherein the image-forming device displays an indication when the photosensitive drum unit is determined to be of an incorrect color.

9. The image-forming device of claim 1, wherein:

the image-forming device also has a counter that indicates cumulative usage of the consumable component by counting repetitions of a predetermined repetitive operation; and the sensing section senses whether the internal fuse has already been blown and, if the consumable component is of the correct type but its internal fuse is not yet blown, resets the counter and blows the internal fuse.

10. The image-forming device of claim 9, wherein, if the consumable component is of the correct type but its internal fuse is not yet blown, the image-forming device displays a query asking whether to reset the counter, and the sensing section resets the counter and blows the internal fuse only if a positive response to the query is obtained.

11. An image-forming device having a consumable component and a counter that indicates cumulative usage of the consumable component by counting repetitions of a predetermined repetitive operation, the consumable component having an internal fuse, the internal fuse being blown by a flow of current when the consumable component is installed, the image-forming device comprising:

first decision means for measuring a resistance of the internal fuse a first predetermined time after said flow of current begins, thereby determining whether the internal fuse is normal;

second decision means for measuring the resistance of the internal fuse, thereby determining whether the internal fuse has blown within a second predetermined time following the first predetermined time;

memory means for storing a fuse defect indication;

setting means for setting the fuse defect indication if the internal fuse fails to blow within the second predetermined time, and clearing the fuse defect indication if the internal fuse blows within the second predetermined time; and resetting means for resetting the counter if the internal fuse is determined to be normal and blows within the second predetermined time, the resetting means also resetting the counter if the internal fuse is determined to be normal and the fuse defect indication is in a cleared state, wherein the consumable component is a photosensitive drum unit having a photosensitive drum, further comprising:

a transfer roller making contact with the photosensitive drum;

a power source supplying current to charge the photosensitive drum through the transfer roller;

fourth decision means for determining an output voltage of the power source, thereby determining whether the photosensitive drum unit is installed; and means for preventing the resetting means from resetting the counter if the photosensitive drum unit is determined not to be installed by the fourth decision means.

12. A consumable component of an image-forming device comprising:

two points of electrical contact between the consumable component and the image-forming device;

a fuse coupled to at least one of the two points of electrical contact, the fuse being blown by the image-forming device to indicate that the consumable component is no longer new; and a resistor coupled to another one of the two points of electrical contact, the resistor and the fuse being connected in series.

13. The consumable component of claim 12, wherein the resistor has different resistance values depending on the type and specifications of the consumable component.

14. The consumable component of claim 12, wherein the resistor is a thermistor having a positive temperature coefficient.

15. The consumable component of claim 13, wherein the consumable component is a toner cartridge.

16. The consumable component of claim 13, wherein the consumable component is a photosensitive drum cartridge.

17. An image-forming device comprising:

a consumable component detachable from and attachable to the image-forming device through an openable cover of the image-forming device, the consumable component including an indicating section indicating a state of the consumable component including whether the consumable component is new or not new and the type of consumable component;

a state-detecting section for detecting the state of the consumable component indicated by the indicating section;

a state-changing section for controlling the state of the indicating section; and a control section for controlling the state-detecting section, wherein when power to the image-forming device is turned on and/or the cover is closed, the state-detecting section detects the state of the consumable component, and the control section causes the state-changing section to change the state of the indicating section if the consumable component is detected as being new.

* * * * *